US008556410B2

(12) United States Patent
Ota et al.

(10) Patent No.: US 8,556,410 B2
(45) Date of Patent: Oct. 15, 2013

(54) IMAGE RECORDING APPARATUS HAVING TRAY GUIDE

(75) Inventors: Yasuhira Ota, Yatomi (JP); Shota Iijima, Nagoya (JP); Naokazu Tanahashi, Nagoya (JP); Iwane Sano, Nagoya (JP); Shingo Ito, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 156 days.

(21) Appl. No.: 13/050,486

(22) Filed: Mar. 17, 2011

(65) Prior Publication Data

US 2011/0242246 A1 Oct. 6, 2011

(30) Foreign Application Priority Data

Mar. 31, 2010 (JP) ..... 2010-081832
Jan. 21, 2011 (JP) ..... 2011-010789

(51) Int. Cl.
*B41J 2/01* (2006.01)

(52) U.S. Cl.
USPC ..... 347/104; 347/101; 347/108

(58) Field of Classification Search
CPC ..... B41J 11/06; B41J 11/07
USPC ..... 347/101–104, 108; 271/3.14; 399/361–410; 400/578–648, 691–694; 226/181, 190; 242/596.7; 346/134–138, 145; 414/754, 788.7, 414/796.5; 198/720, 792; 382/100, 176; 250/239
IPC ..... B41J 2/01
See application file for complete search history.

(56) References Cited

U.S. PATENT DOCUMENTS

| | | | | |
|---|---|---|---|---|
| 6,612,762 | B1 * | 9/2003 | Sakurai et al. | 400/542 |
| 6,988,838 | B2 * | 1/2006 | Inokuchi et al. | 400/59 |
| 7,401,879 | B2 * | 7/2008 | Isono et al. | 347/16 |
| 7,600,866 | B2 * | 10/2009 | Takeshita et al. | 347/101 |
| 2005/0093953 | A1 | 5/2005 | Miyake et al. | |
| 2006/0181566 | A1 | 8/2006 | Miyashita et al. | |
| 2007/0025794 | A1 * | 2/2007 | Kubin et al. | 400/605 |
| 2009/0207227 | A1 | 8/2009 | Miyashita et al. | |

FOREIGN PATENT DOCUMENTS

| | | | |
|---|---|---|---|
| JP | 2005247584 | A | 5/2005 |
| JP | 2006088654 | A | 4/2006 |
| JP | 2010-037095 | A | 2/2010 |

OTHER PUBLICATIONS

European Patent Office, Extended European Search Report for European Patent Application No. 11002186.2, dated Apr. 3, 2012.
Japan Patent Office, Decision to Grant a Patent for Japanese Patent Application No. 2011-010789, dated Apr. 17, 2012.

* cited by examiner

*Primary Examiner* — Manish S Shah
*Assistant Examiner* — Roger W Pisha, II
(74) *Attorney, Agent, or Firm* — Baker Botts L.L.P.

(57) ABSTRACT

An image recording apparatus including: a recording portion; a tray on which a first recording medium is placed; a convey path for conveying a second recording medium and the tray; a tray guide changeable among (a) a first posture in which the tray guide supports the tray, (b) a second posture whose position is different from that of the first posture in a direction intersecting the convey path, and (c) a third posture in which an upstream portion of the tray guide in the tray-enter direction is nearer to the convey path than that in the second posture; a first posture-change portion which changes the tray guide from the second to the third posture; and a second posture-change portion which changes the tray guide from the third to the first posture.

20 Claims, 13 Drawing Sheets

IMAGE RECORDING APPARATUS HAVING TRAY GUIDE

CROSS REFERENCE TO RELATED APPLICATION

The present application claims priority from Japanese Patent Application No. 2010-081832, which was filed on Mar. 31, 2010, and Japanese Patent Application No. 2011-010789, which was filed on Jan. 21, 2011, the disclosures of which are herein incorporated by reference in their entirety.

BACKGROUND OF THE INVENTION

1. Field of the Invention

The present invention relates to an image recording apparatus configured to record an image on a recording medium having a high rigidity such as a CD and a DVD.

2. Description of the Related Art

There is conventionally known an image recording apparatus configured to record an image on a recording medium on the basis of an input signal. A type of image recording of such an image recording apparatus includes an ink-jet recording type and an electronic photography type, for example.

As a recording medium on which an image is recorded by the above-described image recording apparatus, a recording medium having a high rigidity such as a CD and a DVD has been proposed in addition to a recording medium having a low rigidity such as a recording sheet. In general, when the image is recorded on the recording medium having the high rigidity, the recording medium is set on a tray specifically for such a recording medium. In this case, the image recording apparatus is often configured such that the tray is inserted, while being supported on a tray guide, from an insertion opening formed in the apparatus and conveyed in the apparatus.

There is a recording apparatus including a tray guide for supporting a tray on which an optical disc as a recording medium having a high rigidity can be set or placed, wherein a state of the tray guide is changeable between (a) an accommodated state in which the tray guide stands upright when an image is recorded on a recording medium having a low rigidity and (b) an open state in which the tray guide is pivoted toward a front side of the apparatus to support the tray horizontally when the image is recorded on the optical disc.

SUMMARY OF THE INVENTION

In the above-described apparatus, in order for the tray guide to stably support the tray, a support face of the tray guide needs to have a certain length in its open state in a direction in which the recording medium is conveyed. However, where the tray guide is in the accommodated state, the tray guide stands upright. Accordingly, where the tray guide is relatively long, a height of the apparatus becomes relatively high, leading to a larger size of the apparatus.

This invention has been developed in view of the above-described situations, and it is an object of the present invention to provide an image recording apparatus which can change a posture of a tray guide capable of supporting a tray holding a recording medium having a high rigidity, wherein a height of the image recording apparatus can be made or kept low.

The object indicated above may be achieved according to the present invention which provides an image recording apparatus comprising: a recording portion configured to record an image; a tray on which a first recording medium is placed, wherein the recording portion is configured to record the image on the first recording medium; a convey path through which is conveyed one of a second recording medium and the tray on which the first recording medium is placed, wherein the recording portion is configured to record the image on the second recording medium; a tray guide whose posture is changeable among (a) a first posture in which the tray guide supports the tray such that the tray is enabled to enter into the convey path, (b) a second posture in which the tray guide is located at a position different from a position of the tray guide in the first posture in a direction intersecting the convey path, and the tray guide is located on a downstream side of the position of the tray guide in the first posture in a tray-enter direction in which the tray enters into the convey path, and (c) a third posture in which an upstream portion of the tray guide in the tray-enter direction is nearer to the convey path than the upstream portion of the tray guide in the second posture; a first posture-change portion configured to change the posture of the tray guide from the second posture to the third posture by pivoting the tray guide in the second posture about a downstream portion of the tray guide in the tray-enter direction such that the upstream portion of the tray guide is moved toward the convey path; and a second posture-change portion configured to change the posture of the tray guide from the third posture to the first posture by moving the downstream portion of the tray guide in the third posture toward the convey path and by moving the tray guide to an upstream side thereof in the tray-enter direction.

BRIEF DESCRIPTION OF THE DRAWINGS

The objects, features, advantages, and technical and industrial significance of the present invention will be better understood by reading the following detailed description of an embodiment of the invention, when considered in connection with the accompanying drawings, in which:

FIGS. 6A, 6B, 6C, and 6D are elevational views in vertical cross section showing a left guide member 91 when seen from the left side in a second modification, wherein FIG. 6A shows that a tray guide 72 is in a second posture, FIG. 6B shows that the tray guide 72 is in a third posture where the tray guide 72 is changed from the second posture, FIG. 6C shows that the tray guide 72 is in a first posture, and FIG. 6D shows that the tray guide 72 is in a third posture when the tray guide 72 is changed from the first posture;

FIGS. 8A and 8B are external perspective views schematically showing a projecting plate 85, wherein FIG. 8A shows a projecting plate 85 including a first recessed part 86, and FIG. 8B shows a projecting plate 85 including a first projecting part 89;

FIGS. 9A, 9B, and 9C are schematic views showing the projecting plate 85, wherein FIG. 9A is an elevational view in vertical cross section showing the projecting plate 85 with the tray guide 72 being in the first posture, FIG. 9B is an elevational view in vertical cross section showing the projecting plate 85 with the tray guide 72 being in the third posture, and FIG. 9C is a plan view of the projecting plate 85;

DESCRIPTION OF THE EMBODIMENT

Hereinafter, there will be described an embodiment of the present invention by reference to the drawings. It is to be understood that the following embodiment is described only by way of example, and the invention may be otherwise embodied with various modifications without departing from the scope and spirit of the invention. In this embodiment, an upward and downward direction 7 is defined as a top and bottom direction of a multi-function device (MFD) 10 set in a usable state (shown in FIG. 1). A frontward and rearward direction 8 is defined in a state in which a side of the MFD 10 on which an opening 13 is formed is a front side. A rightward and leftward direction 9 is defined in a state in which the MFD 10 is viewed from the front side.

<Multi-Function Device 10>

Figure 1:
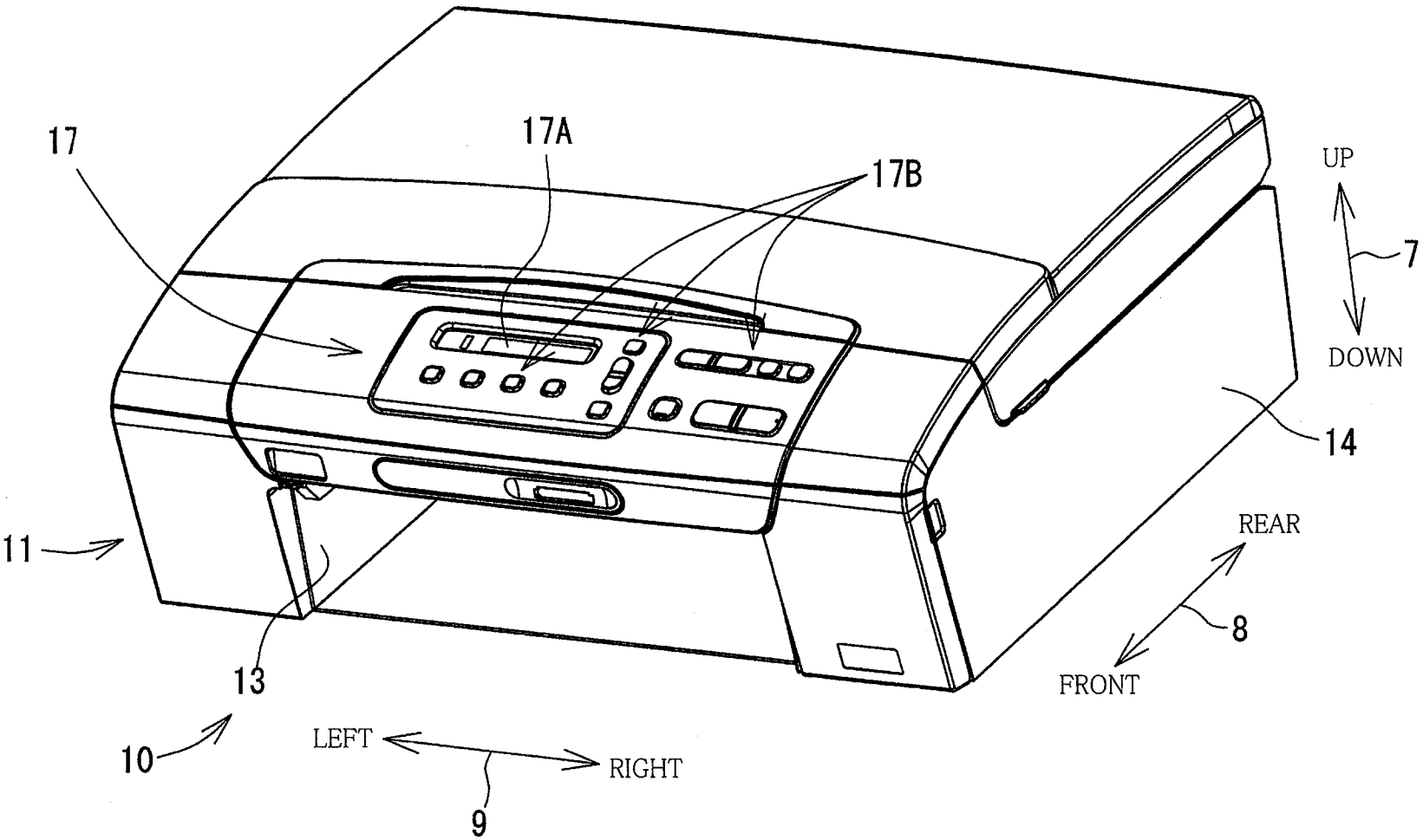
FIG. 1 is an external perspective view showing an MFD "multi-function device") 10 as an example of the present invention.

The MFD 10 is an example of an image recording apparatus to which the present invention is applied. As shown in FIG. 1, the MFD 10 is of a slim type having a generally rectangular parallelepiped shape. A printing section 11 of an ink-jet recording type is provided on a lower portion of the MFD 10. The MFD 10 has various functions such as a facsimile function and a printing function. It is noted that functions other than the printing function are optional and accordingly may be omitted.

The printing section 11 includes a casing 14 having the opening 13 on its front side. A sheet-supply tray 20 and a sheet-discharge tray 21 (see FIG. 2) can be inserted or removed through the opening 13 in the frontward and rearward direction 8. The sheet-supply tray 20 can accommodate therein a plurality of recording sheets of desired sizes such as A4 size and B5 size. The recording sheet is an example of a second recording medium. Further, the sheet-discharge tray 21 is supported and disposed on the sheet-supply tray 20. The trays 20, 21 are superposed on each other in a vertical direction and mounted in the MFD 10.

<Operational Panel 17>

An operational panel 17 is provided on a front and upper face of the MFD 10. The operational panel 17 is a device for a user to operate the printing section 11. The MFD 10 is operated on the basis of the operation inputted through the operational panel 17. The operational panel 17 includes a liquid crystal display 17A and a plurality of operational switches 17B. The operational switches 17B include keys, buttons, and levers, for example.

The user operates (e.g., presses) one or ones of the operational switches 17B on the basis of a message displayed on the liquid crystal display 17A such as a state of the MFD 10 and an instruction of the operation, whereby the MFD 10 is operated. It is noted that the liquid crystal display 17A may include a touch panel. In this case, some or all of the operational switches 17B are displayed on the liquid crystal display 17A.

<Printing Section 11>

Figure 2:
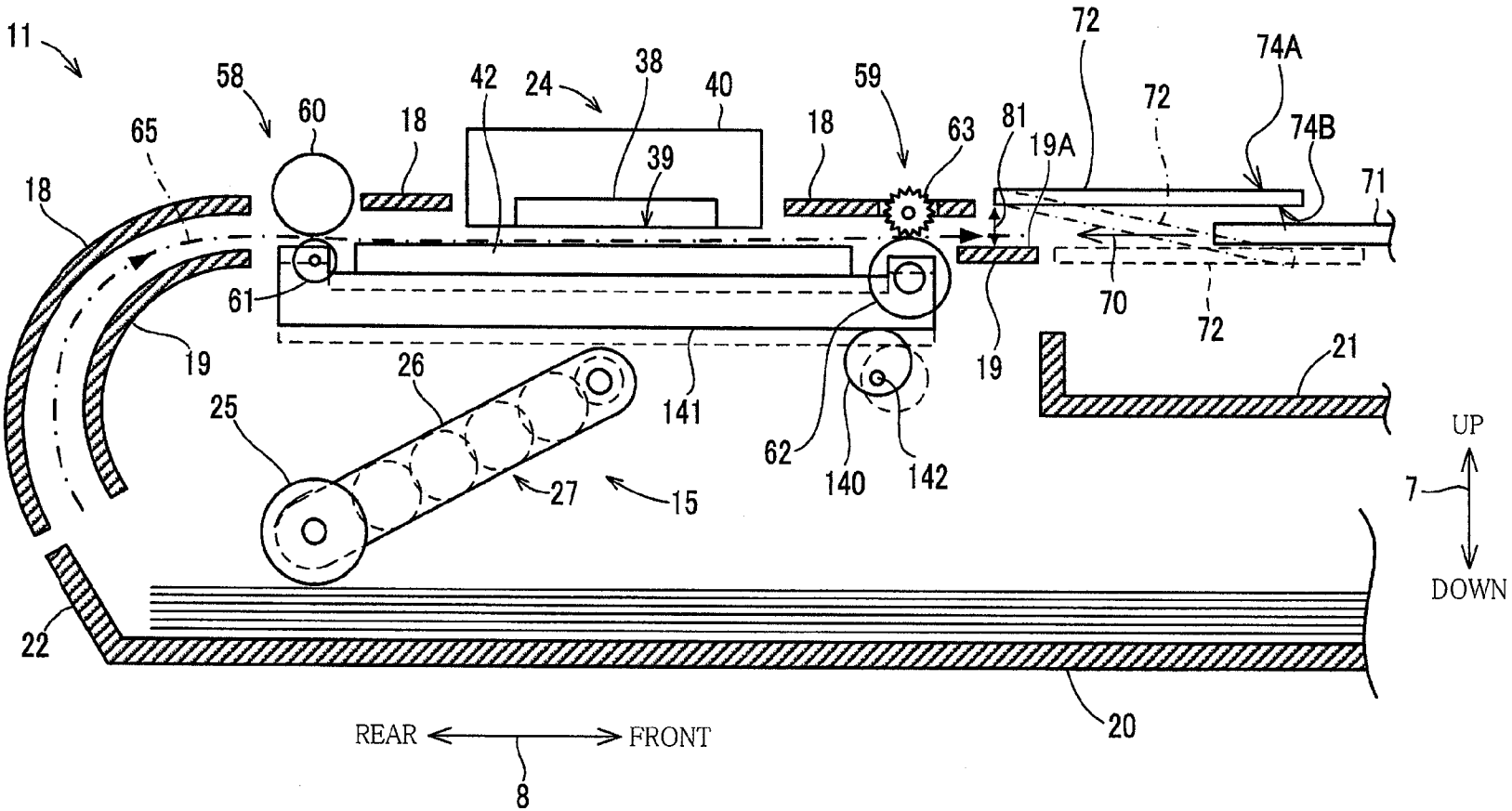
FIG. 2 is an elevational view in vertical cross section schematically showing an internal structure of a printing section 11.

As shown in FIG. 2, the printing section 11 includes a sheet-supply portion 15, a recording portion 24, and so on. The sheet-supply portion 15 supplies one of the recording sheets stacked on the sheet-supply tray 20. The recording portion 24 of an ink-jet recording type ejects ink droplets onto the recording sheet supplied by the sheet-supply portion to record an image on the recording sheet. It is noted that, in FIG. 2, an illustration of a front portion of the sheet-supply tray 20 (a right side in FIG. 2) is omitted. Further, the recording portion 24 is not limited to the ink-jet type and may be of other types such as an electronic photography type, for example.

The MFD 10 is used in a state in which the MFD 10 is connected to an external device, not shown, such as a computer. The printing section 11 records an image on the recording sheet on the basis of recording data or the like received from the external device. Further, the MFD 10 has a function for recording an image by the recording portion 24 on a disc surface of a storage medium (such as a CD-ROM and a DVD-ROM) having a high rigidity and a thickness larger than that of the recording sheet. Such a storage medium is an example of a first recording medium. This function will be explained later.

<Convey Path 65>

On a rear side of the sheet-supply tray 20 mounted on the MFD 10, there is disposed an inclined sheet-separate plate 22 which extends in the rightward and leftward direction 9 (perpendicular to a sheet face of FIG. 2). The inclined sheet-separate plate 22 is provided at a rear end portion of the sheet-supply tray 20 so as to be inclined obliquely upward and rearward. Where a plurality of the recording sheets are supplied from the sheet-supply tray 20, the inclined sheet-separate plate 22 separates the recording sheets to guide an uppermost one of the sheets upward.

A convey path 65 is defined above the inclined sheet-separate plate 22. The convey path 65 curves upward from a position just above the inclined sheet-separate plate 22 and extends from the rear side to the front side. The convey path 65 reaches the sheet-discharge tray 21 by passing through a nipping position of a first roller pair 58, a position below the recording portion 24, and a nipping position of a second roller pair 59.

The recording sheet is fed through the first convey path 65 in a sheet feeding direction indicated by one-dot chain line arrow shown in FIG. 2. That is, the recording sheet supplied from the sheet-supply tray 20 reaches the recording portion 24 so as to make an upward U-turn in the convey path 65. After image recording by the recording portion 24, the recording sheet is discharged onto the sheet-discharge tray 21.

The convey path 65 is defined by an outer guide member 18 and an inner guide member 19 with a specific distance therebetween.

<Sheet-Supply Portion 15>

A sheet-supply roller 25 is provided on an upper side of the sheet-supply tray 20. The sheet-supply roller 25 is supported by a free end of portion of a sheet-supply arm 26 pivotable in the upward and downward direction 7 so as to be moved toward and away from the sheet-supply tray 20. The sheet-supply roller 25 is rotated by a drive power of a sheet-supply motor, not shown, which is transmitted by a drive-power transmitting mechanism 27 including a plurality of gears meshed with one another. The sheet-supply roller 25 supplies the recording sheets stacked on the sheet-supply tray 20 one by one to the first convey path 65. Specifically, the sheet-supply roller 25 is rotated in a state in which the sheet-supply roller 25 is held in pressing contact with an uppermost one of the recording sheets stacked on the sheet-supply tray, whereby the uppermost recording sheet is supplied toward the inclined sheet-separate plate 22 by a friction between the recording sheet and a roller surface (an outer circumferential surface) of the sheet-supply roller 25. The supplied recording sheet is guided upward by being brought into contact at its leading end with the inclined sheet-separate plate 22, and then conveyed into the convey path 65.

<Recording Portion 24>

The recording portion 24 includes a recording head 38 and a carriage 40. The recording head 38 is mounted on the carriage 40 which is reciprocal in a main scanning direction (i.e., a direction perpendicular to the sheet face of FIG. 2). Inks of four colors, namely, cyan (C), magenta (M), yellow (Y), and black (Bk) are respectively supplied from ink cartridges, not shown, to the recording head 38. The recording head 38 ejects fine ink droplets from nozzles 39 formed in a lower face of the recording head 38. The carriage 40 is reciprocated in the main scanning direction, whereby the recording head 38 is accordingly reciprocated relative to the recording sheet. The recording head 38 ejects the inks while being reciprocated, to record an image on the recording sheet being fed on a platen 42 provided below the recording portion 24 so as to be opposed to the recording portion 24. The platen 42 supports the recording sheet and a medium tray 71 which will be described below. Further, the platen 42 defines a distance between (a) the recording portion 24 and (b) the recording sheet or the storage medium (such as a CD-ROM and a DVD-ROM) placed on the medium tray 71.

<First Roller Pair 58, Second Roller Pair 59>

The first roller pair 58 is provided on an upstream side of the recording portion 24 in the sheet feeding direction. The first roller pair 58 is constituted by a pair of rollers: a first convey roller 60 and a pinch roller 61. The pinch roller 61 is held in pressing contact with a roller face of the first convey roller 60 by a member such as a spring, not shown. The first roller pair 58 nips and feeds or conveys, onto the platen 42, the recording sheet supplied from the sheet-supply tray 20 and fed through the convey path 65.

The second roller pair 59 is provided on a downstream side of the recording portion 24 in the sheet feeding direction. The second roller pair 59 is constituted by a pair of rollers: a second convey roller 62 and a spur roller 63. Like the pinch roller 61, the spur roller 63 is held in pressing contact with a roller face of the second convey roller 62. The second roller pair 59 nips and feeds or conveys the recording sheet on which the image has been recorded by the recording portion 24, toward the sheet-discharge tray 21 or toward a downstream side in the sheet feeding direction.

The first convey roller 60 and the second convey roller 62 are rotated by a drive power of a convey motor, not shown, which is transmitted via a drive-power transmitting mechanism, not shown. The drive-power transmitting mechanism is constituted by a planetary gear and other power transmitting components. Where the convey motor is rotated in one of forward and reverse directions (in a forward direction in the present embodiment), the rollers 60, 62 are rotated such that the recording sheet or the medium tray 71 is conveyed in the sheet feeding direction. On the other hand, where the convey motor is rotated in the other of the forward and reverse directions (in a reverse direction in the present embodiment), the rollers 60, 62 are rotated such that the recording sheet or the medium tray 71 is conveyed in a direction opposite to the sheet feeding direction.

<Change of Postures of First Roller Pair 58, Second Roller Pair 59, and Platen 42>

Each of the first roller pair 58 and the second roller pair 59 can change its posture between (a) a contact posture in which the rollers thereof contact with each other and (b) a distant posture in which the rollers thereof are distant from each other. Where the first roller pair 58 is in the contact posture, the first roller pair 58 can nip the recording sheet therebetween to feed the recording sheet toward the recording portion 24 through the convey path 65. Likewise, where the second roller pair 59 is in the contact posture, the second roller pair 59 can nip the recording sheet therebetween to feed the recording sheet toward the sheet discharge tray 21 through the convey path 65. On the other hand, where each of the first roller pair 58 and the second roller pair 59 is in the distant posture, a distance between the rollers thereof becomes a distance suitable for the rollers to nip the medium tray 71 therebetween. Thus, in the case of the distant posture, each of the first roller pair 58 and the second roller pair 59 can nip the medium tray 71 therebetween to convey the medium tray 71 through the convey path 65. In the present embodiment, the pinch roller 61 and the second convey roller 62 as respective lower rollers of the first roller pair 58 and the second roller pair 59 are moved downward, whereby the posture of each of the first roller pair 58 and the second roller pair 59 is changed from the contact posture to the distant posture.

Further, the platen 42 is also movable downward. Where the platen 42 is not moved downward, a distance between the platen 42 and the recording portion 24 is a distance in which the recording sheet can be fed under the recording portion 24. On the other hand, where the platen 42 has been moved downward, the distance becomes a distance in which the medium tray 71 can be conveyed under the recording portion 24.

The pinch roller 61, the second convey roller 62, and the platen 42 are moved downward, e.g., by an eccentric cam 140 and a third guide member 141 provided below the pinch roller 61, the second convey roller 62, and the platen 42. The eccentric cam 140 is supported by a frame, not shown, partly constituting the casing 14 of the MFD 10, so as to be rotatable about a shaft 142 extending in the rightward and leftward direction 9. The eccentric cam 140 is a circular disc in which a position of the shaft 142 is displaced from a center of the eccentric cam 140, and accordingly distances between the shaft 142 and circumferential positions of a circumferential face of the eccentric cam 140 vary.

The third guide member 141 is supported or placed on the eccentric cam 140. The pinch roller 61 and the second convey roller 62 are supported by the third guide member 141 so as to be rotatable. The platen 42 is supported by the third guide member 141.

In the present embodiment, the eccentric cam 140 is rotated by a drive power of a motor, not shown. When the eccentric cam 140 is rotated, the outer circumferential face is slid relative to the third guide member 141. Since the distances between the shaft 142 and the circumferential positions of the circumferential face of the eccentric cam 140 vary, the third guide member 141 is moved in the upward and downward direction 7. The movement of the third guide member 141 in the upward and downward direction 7 moves the pinch roller 61, the second convey roller 62, and the platen 42 in the upward and downward direction 7. In FIG. 2, a state in which the third guide member 141 has moved upward is indicated by a solid line, and a state in which the third guide member 141 has moved downward is indicated by a broken line.

It is noted that the MFD 10 may be configured such that, instead of the downward movement of the platen 42, upward movement of the recording portion 24 changes the distance between the platen 42 and the recording portion 24. Further, a method of the change of the posture of each of the first roller pair 58 and the second roller pair 59 is not limited to the downward movement of the pinch roller 61 and the second convey roller 62. For example, the change of the posture may be performed by upward movement of the first convey roller 60 and the spur roller 63.

<Medium Tray 71>

As described above, the MFD 10 has the function for recording the image on the disc surface of the storage medium such as a CD-ROM and a DVD-ROM. Where the image is recorded on the disc surface of the storage medium, the storage medium is placed or mounted on the medium tray 71. It is noted that a case where the storage medium is placed on the medium tray 71 is explained in the present embodiment, a recording medium placed on the medium tray 71 is not limited to the storage medium. That is, a medium other than the storage medium (e.g., the recording sheet) may be placed on the medium tray 71. It is noted that a thickness of the medium tray 71 is larger than that of the recording sheet.

Figure 3:
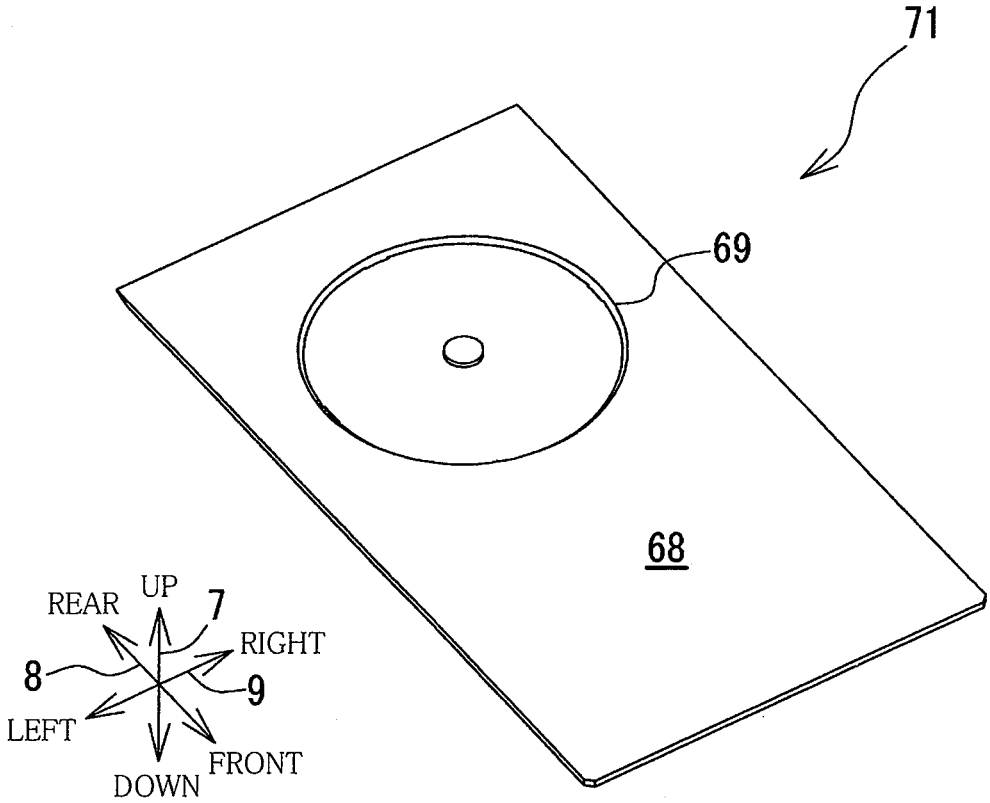
FIG. 3 is a perspective view showing a medium tray 71.

As shown in FIG. 3, the medium tray 71 is formed of a resin and has a thickness of a few millimeters (e.g., 2 to 3 mm) in the upward and downward direction 7. Each of a length of the medium tray 71 in its conveying direction (i.e., in the frontward and rearward direction 8) and a length thereof in its widthwise direction (i.e., in the rightward and leftward direction 9) is longer than the thickness thereof in the upward and downward direction 7. The length of the medium tray 71 in the conveying direction is longer than the length thereof in the widthwise direction. That is, the medium tray 71 is a resin plate of a slim type having a rectangular parallelepiped shape. An upper face 68 of the medium tray 71 has a circular recess as a medium placed portion 69 on which the storage medium is placed or mounted.

As shown in FIG. 2, the medium tray 71 is inserted by the user from the opening 13 (formed in the front side of the MFD 10) along the convey path 65 in a direction indicated by an arrow 70 which is opposite to the sheet feeding direction (noted that the direction indicated by the arrow 70 may be hereinafter referred to as a "tray-enter direction"). In this time, the medium tray 71 is inserted in a state in which the medium tray 71 is placed or mounted on a tray guide 72 which will be described below.

Where a sensor, not shown, has detected the insertion of the medium tray 71, the first convey roller 60 and the second convey roller 62 are driven so as to be rotated reversely, and the pinch roller 61, the second convey roller 62, and the platen 42 are moved downward. As a result, the posture of each of the first roller pair 58 and the second roller pair 59 is changed from the contact posture to the distant posture.

When the medium tray 71 inserted along the tray guide 72 has been brought into contact with the second roller pair 59, the medium tray 71 is conveyed by the second roller pair 59 in the direction opposite to the sheet feeding direction. As a result, the medium tray 71 passes through the position under the recording portion 24 and contacts the first roller pair 58 from the downstream side in the sheet feeding direction. The medium tray 71 nipped by the first roller pair 58 and the second roller pair 59 is guided further toward the upstream side in the sheet feeding direction.

As a result, the storage medium placed on the medium tray 71 is positioned on an upstream side of the recording portion 24 in the sheet feeding direction. At this time, the first convey roller 60 and the second convey roller 62 are temporarily stopped, and then the rotational direction of the first convey roller 60 and the second convey roller 62 is changed from the reverse direction to the forward direction. As a result, the medium tray 71 is conveyed in the sheet feeding direction and then the storage medium placed on the medium tray 71 passes through the platen 42. The recording head 38 ejects the ink droplets onto the storage medium being conveyed on the platen 42. As a result, the image is recorded on the disc surface of the storage medium. After this image recording, the medium tray 71 is discharged to the tray guide 72.

<Tray Guide 72>

As shown in FIG. 2, the tray guide 72 is provided on a front portion of the convey path 65 in the MFD 10. Specifically, the tray guide 72 is disposed at an upstream side of inner guide member 19 in the tray-enter direction. The tray guide 72 has a generally slim flat-plate shape in which a thickness thereof in the upward and downward direction 7 is shorter than each of a length thereof in the tray-enter direction (i.e., in the frontward and rearward direction 8) and a length thereof in its widthwise direction (i.e., in the rightward and leftward direction 9). As shown in FIG. 4, the tray guide 72 includes: a bottom plate 74; a right guide plate 75 and a left guide plate 76; a first shaft rod (portion) 77 and a second shaft rod (portion) 78; a third shaft rod (portion) 79 and a fourth shaft rod (portion) 80; and the like. The bottom plate 74 has an upper face 74A and a lower face 74B, and the medium tray 71 is placed on the upper face 74A (as an example of a support face). The right guide plate 75 and the left guide plate 76 are respectively provided at opposite end portions of the bottom plate 74 in the rightward and leftward direction 9 so as to stand upright from the upper face 74A of the bottom plate 74. Further, the right guide plate 75 and the left guide plate 76 are disposed along the direction in which the medium tray 71 is inserted. The first shaft rod 77 and the second shaft rod 78 project from a right end portion of the bottom plate 74 in the rightward and leftward direction 9. The third shaft rod 79 and the fourth shaft rod 80 project from a left end portion of the bottom plate 74 in the rightward and leftward direction 9. Each of the first shaft rod 77 and the third shaft rod 79 is an example of a first shaft portion, and each of the second shaft rod 78 and the fourth shaft rod 80 is an example of a second shaft portion.

The medium tray 71 is placed on the upper face 74A of the bottom plate 74. A distance between a left face of the right guide plate 75 and a right face of the left guide plate 76 is equal to or slightly larger than a length of the medium tray 71 in its widthwise direction (i.e., the rightward and leftward direction 9). As a result, even where the medium tray 71 is inserted from the opening 13 while being placed on the bottom plate 74, the medium tray 71 is not deviated in the rightward and leftward direction 9 upon the insertion.

The first shaft rod 77 and the third shaft rod 79 are provided at positions near a front end 74C of the bottom plate 74. A distance between the first shaft rod 77 and the front end 74C of the bottom plate 74 in the frontward and rearward direction 8 is the same as a distance between the third shaft rod 79 and the front end 74C of the bottom plate 74 in the frontward and rearward direction 8. That is, the first shaft rod 77 and the third shaft rod 79 are located at the same position in the rightward and leftward direction 9. Further, the second shaft rod 78 and the fourth shaft rod 80 are provided at positions near a rear end 74D of the bottom plate 74. That is, the second shaft rod 78 and the fourth shaft rod 80 are provided on a downstream side of the first shaft rod 77 and the third shaft rod 79 in the direction in which the medium tray 71 is inserted (i.e., the direction indicated by the arrow 70 in FIG. 2). A distance between the second shaft rod 78 and the front end 74C of the bottom plate 74 in the frontward and rearward direction 8 is the same as a distance between the fourth shaft rod 80 and the front end 74C of the bottom plate 74 in the frontward and rearward direction 8. That is, the second shaft rod 78 and the fourth shaft rod 80 are located at the same position in the rightward and leftward direction 9.

A right guide member 90 as an example of a support member is disposed at a position opposite to a right end portion of the tray guide 72 in the printing section 11. A left guide member 91 as another example of the support member is disposed at a position opposed to a left end portion of the tray guide 72 in the printing section 11. Each of the right guide member 90 and the left guide member 91 is one of frames constituting the casing 14 of the MFD 10, for example.

A right front guide groove 92 (an example of a first guide groove) is formed in the right guide member 90 at a position opposed to the first shaft rod 77. A right rear guide groove 93 (an example of a second guide groove) is formed in the right guide member 90 at a position opposed to the second shaft rod 78. A left front guide groove 94 (another example of the first guide groove) is formed in the left guide member 91 at a position opposed to the third shaft rod 79. A left rear guide groove 95 (another example of the second guide groove) is formed at a position opposed to the fourth shaft rod 80.

That is, a front portion of the right guide member 90 at which the right front guide groove 92 is formed and a front portion of the left guide member 91 at which the left front guide groove 94 is formed function as a first guide member. Further, a rear portion of the right guide member 90 at which the right rear guide groove 93 is formed and a rear portion of the left guide member 91 at which the left rear guide groove 95 is formed function as a second guide member.

In the present embodiment, each of the guide grooves 92-95 is formed by an elongate hole. Specifically, as shown in FIGS. 5A-5C and 7A, each of the front guide grooves 92, 94 is constituted by a first elongate hole 151 and a second elongate hole 152 continuous to each other. The first elongate hole 151 extends along a pivot path of the first shaft rod 77 and the third shaft rod 79 in a case where the tray guide 72 is pivoted about the second shaft rod 78 and the fourth shaft rod 80 as pivot shafts. The second elongate hole 152 extends forward from a lower end portion of the first elongate hole 151. Here, the first elongate hole 151 is formed by an arc-shaped elongate hole, and its circular arc is a segment of a circle centered about a pivot shaft (the fourth shaft rod 80 in FIGS. 5A-5C and 7A) of the tray guide 72, the segment being continued between an upper end portion 107 and a lower end portion 108 of the first elongate hole 151. It is noted that, in FIGS. 5A-5C and 7A, the first elongate hole 151 has a circular arc close to a straight line because a radius of the circle centered about the pivot shaft of the tray guide 72 is long when compared with a length of the first elongate hole 151. The second elongate hole 152 is an elongate hole having a straight line shape which is continued between the lower end portion 108 and a front end portion 109 in the frontward and rearward direction 8. Each of the rear guide grooves 93, 95 is constituted by a fourth elongate hole 154 and a short hole 155 continuous to each other. The fourth elongate hole 154 has a straight line shape extending generally obliquely frontward and downward from a rear upper end portion 110 as one end portion of the fourth elongate hole 154. The short hole 155 has a straight line shape extending frontward from the other end portion of the fourth elongate hole 154 to a front lower end portion 111 of the short hole 155.

The first shaft rod 77 is fitted or engaged in the right front guide groove 92. The second shaft rod 78 is fitted or engaged in the right rear guide groove 93. The third shaft rod 79 is fitted or engaged in the left front guide groove 94. The fourth shaft rod 80 is fitted or engaged in the left rear guide groove 95. As a result, the tray guide 72 is supported at the right end portion thereof by the right guide member 90 and supported at the left end portion thereof by the left guide member 91.

<Change of Posture of Tray Guide 72>

Each of the shaft rods 77-80 is movable along a corresponding one of the guide grooves 92-95. This enables the tray guide 72 to take different postures in accordance with a position of each of the shaft rods 77-80 fitted in the corresponding one of the guide grooves 92-95. In the present embodiment, the posture of the tray guide 72 is changeable among first, second, and third postures. In the first posture, the tray guide 72 supports the medium tray 71 such that the medium tray 71 can enter into the convey path 65. In the second posture, the medium tray 71 is located at a position retracted from the convey path 65 and located on an upper and rear side of the position of the medium tray 71 being in the first posture. In the third posture, a front portion of the medium tray 71 is located on a lower side of a position of the front portion of the medium tray 71 being in the second posture by the pivot movement of the medium tray 71 about the second shaft rod 78 and the fourth shaft rod 80 as the pivot shafts provided on the rear portion of the tray guide 72.

Figure 4A:
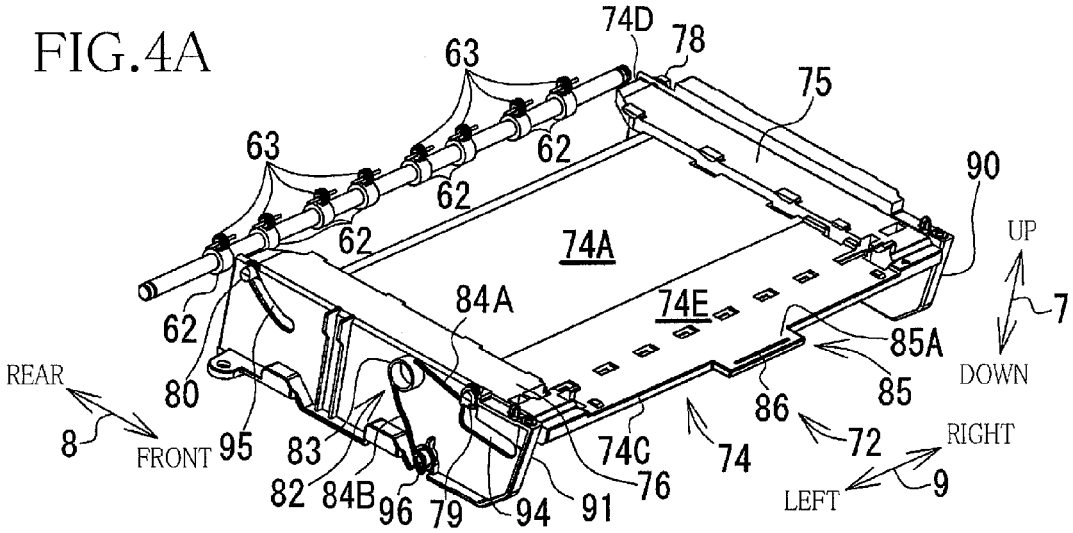
FIGS. 4A, 4B, and 4C are external perspective views showing a tray guide 72 which is in a second posture in FIG. 4A, in a third posture in FIG. 4B, and in a first posture in FIG. 4C.
Figure 4B:
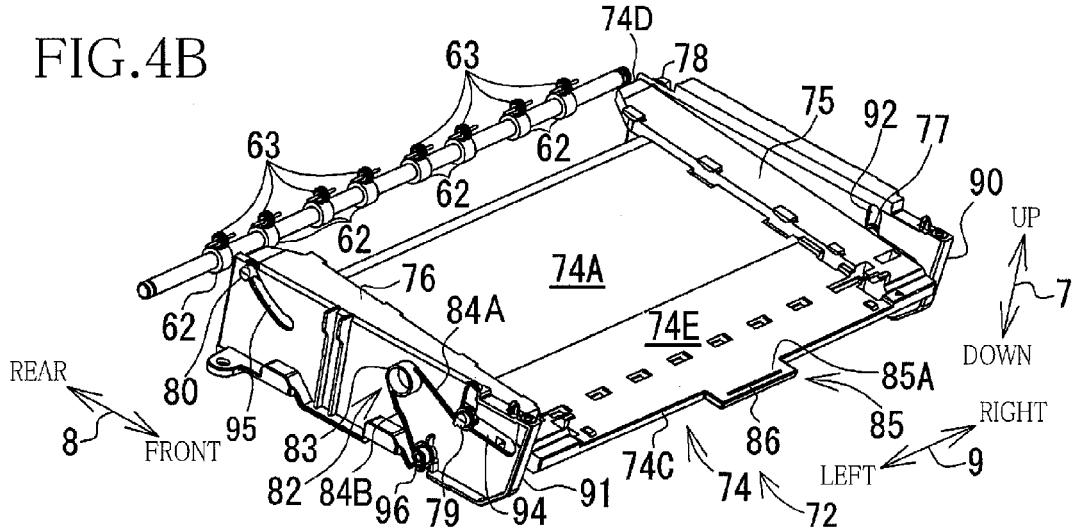
Figure 4C:
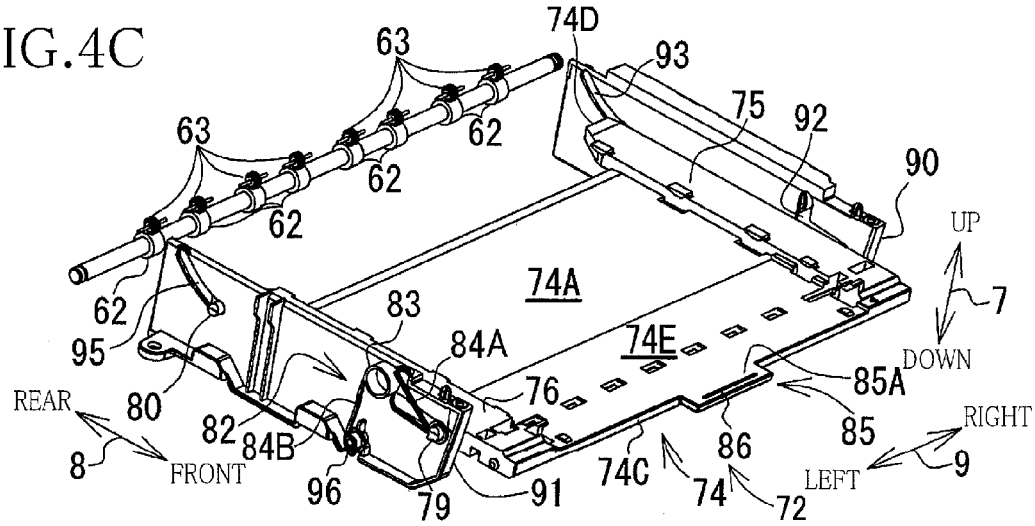
Figure 5A:
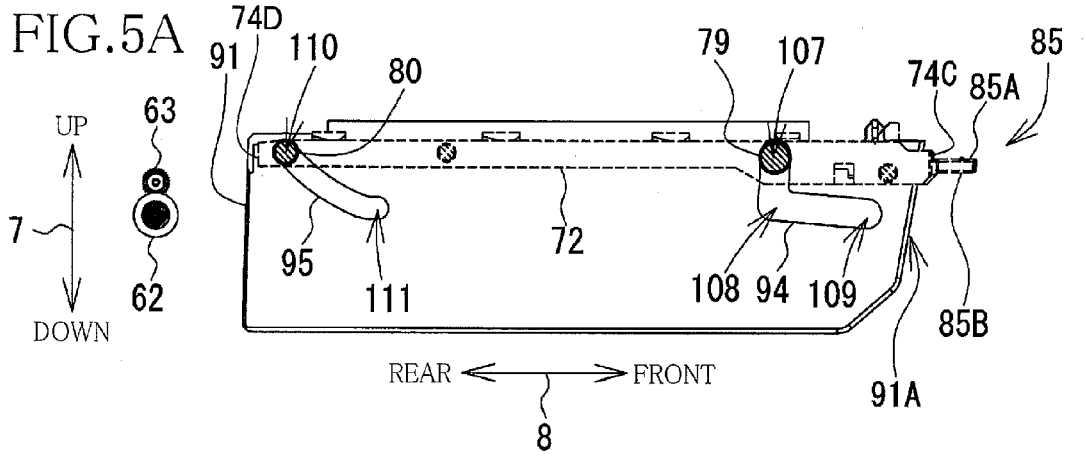
FIGS. 5A, 5B, and 5C are elevational views in vertical cross section showing a left guide member 91 when seen from the left side, wherein the tray guide 72 is in the second posture in FIG. 5A, in the third posture in FIG. 5B, and in the first posture in FIG. 5C.
Figure 5B:
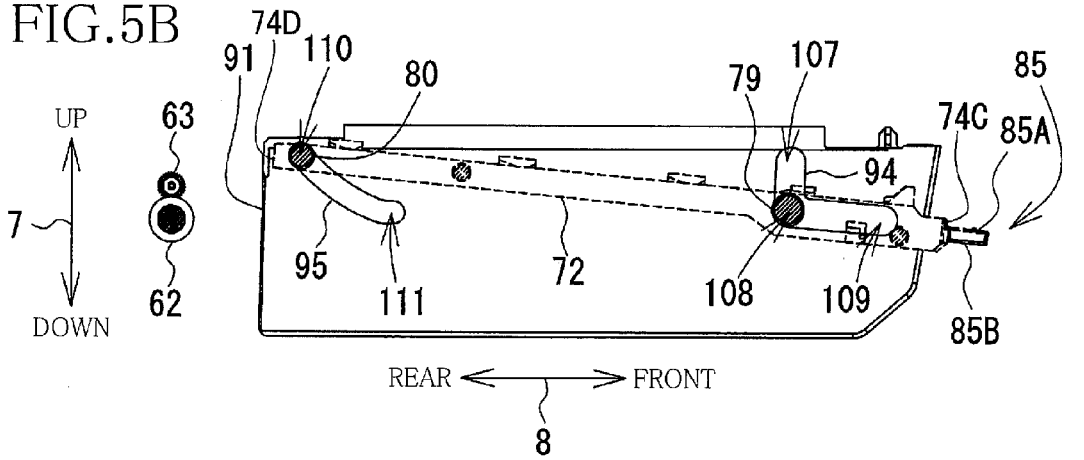
Figure 5C:
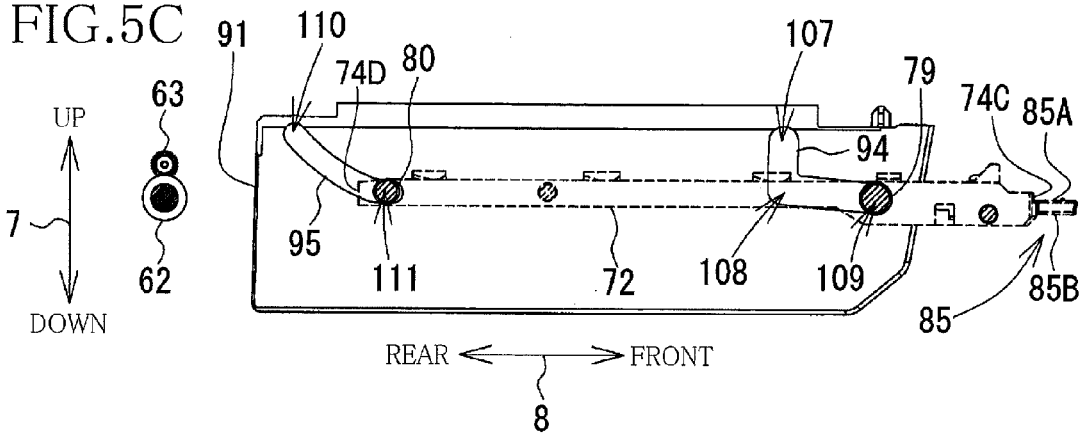

As shown in FIGS. 4C and 5C, the first posture is a posture in which the upper face 74A of the bottom plate 74 is horizontal, that is, the first posture is a posture in which the upper face 74A expands in the frontward and rearward direction 8. Further, as indicated by a broken line in FIG. 2, where the tray guide 72 is in the first posture, the upper face 74A is positioned at the same height in the upward and downward direction 7 as an upper face 19A of the inner guide member 19 which functions as a lower guide face of the convey path 65 extending from the rear side to the front side of the MFD 10 (that is, the upper face 19A defines the convey path 65 at a position located on the lower side of the convey path 65). Further, where the tray guide 72 is in the first posture, the upper face 74A is positioned in the frontward and rearward direction 8 such that a rear end portion of the upper face 74A is located near a front end portion of the inner guide member 19 (near the sheet-discharge tray 21) which functions as the lower guide face of the convey path 65 extending from the rear side to the front side of the MFD 10. Further, as shown in FIGS. 4C and 5C, where the tray guide 72 is in the first posture, each of the first shaft rod 77 and the third shaft rod 79 is positioned at the front end portion 109 of a corresponding one of the front guide grooves 92, 94, and each of the second shaft rod 78 and the fourth shaft rod 80 is positioned at the front lower end portion 111 of a corresponding one of the rear guide grooves 93, 95.

In view of the above, where the tray guide 72 is in the first posture, the medium tray 71 placed on the upper face 74A can enter into the convey path 65 by being conveyed on the upper face 74A and the upper face 19A (located at substantially the same height as each other) in the direction opposite to the sheet feeding direction.

As shown in FIGS. 4A and 5A, where the tray guide 72 is in the second posture, the upper face 74A of the bottom plate 74 expands in the frontward and rearward direction 8 as in the first posture. However, as indicated by a solid line in FIG. 2, the second posture is different from the first posture in that the upper face 74A is positioned higher in the upward and downward direction 7 than the upper face 19A of the inner guide member 19 which functions as the lower guide face of the convey path 65 extending from the rear side to the front side of the MFD 10. Further, where the tray guide 72 is in the second posture, the upper face 74A is positioned on a rear side of the upper face 74A of the tray guide 72 being in the first posture in the frontward and rearward direction 8. Specifically, the tray guide 72 being in the second posture is positioned on a rear side of the tray guide 72 being in the first posture in the frontward and rearward direction 8 by a length of each of the guide grooves 92-95 in the frontward and rearward direction 8. Further, as shown in FIGS. 4A and 5A, where the tray guide 72 is in the second posture, each of the first shaft rod 77 and the third shaft rod 79 is positioned at the upper end portion 107 of the corresponding one of the front guide grooves 92, 94, and each of the second shaft rod 78 and the fourth shaft rod 80 is positioned at the rear upper end portion 110 of the corresponding one of the rear guide grooves 93, 95. That is, the tray guide 72 being in the second posture is located on an upper side of the convey path 65.

As shown in FIG. 2, where the posture of the tray guide 72 has been changed to the second posture, a clearance (opening) 81 is formed between the lower face 74B of the bottom plate 74 and the upper face 19A of the inner guide member 19. The clearance 81 continues to an outside of the MFD 10 and allows the recording sheet to be fed through the clearance 81 when the recording sheet fed through the convey path 65 in the sheet feeding direction is discharged onto the sheet-discharge tray 21. That is, a distance from the tray guide 72 being in the first posture to the tray guide 72 being in the second posture when the tray guide 72 is moved or retracted upward to change its posture from the first posture to the second posture is set at least a distance for forming the clearance 81. In other words, the distance between the tray guide 72 being in the first posture and the tray guide 72 being in the second posture is a distance enough to form at least the clearance 81, and a distance (i.e., a height) of the clearance 81 is larger than the thickness of the recording sheet.

It is noted that the second posture does not need to be the posture in which the upper face 74A expands in the frontward and rearward direction 8 as long as the tray guide 72 being in the first posture is retracted by a distance equal to or greater than the distance for forming the clearance 81. For example, in the second posture, a front portion of the tray guide 72 or a projecting plate 85 which will be descried below may be located at a position lower in height than the convey path 65 extending from the rear side to the front side of the MFD 10. This is because, even where the tray guide 72 is located at such a position, the recording sheet fed through the convey path 65 in the sheet feeding direction can be discharged onto the sheet-discharge tray 21 through the clearance 81.

As shown in FIGS. 4B and 5B and indicated by a one-dot chain line in FIG. 2, where the tray guide 72 is in the third posture, the upper face 74A inclines obliquely downward from a rear side toward a front side thereof. An angle of the inclination with respect to the frontward and rearward direction 8 is smaller in an absolute value than an angle of the inclination of each of the rear guide grooves 93, 95 described above. That is, the inclination of the tray guide 72 being in the third posture is gentler than that of each of the rear guide grooves 93, 95. Where the tray guide 72 is in the third posture, each of the first shaft rod 77 and the third shaft rod 79 is positioned at the lower end portion 108 of the corresponding one of the front guide grooves 92, 94, and each of the second shaft rod 78 and the fourth shaft rod 80 is positioned at the rear upper end portion 110 of the corresponding one of the rear guide grooves 93, 95.

The posture of the tray guide 72 is changed from the second posture to the third posture in the following manner. When the user of the MFD 10 has pressed downward a portion of the upper face 74A of the bottom plate 74 which portion is located near a front end of the tray guide 72, the tray guide 72 is pivoted about the second shaft rod 78 and the fourth shaft rod 80 as the pivot shafts. Specifically, the tray guide 72 is rotated in the state in which each of the second shaft rod 78 and the fourth shaft rod 80 is fitted in the rear upper end portion 110 of the corresponding one of the rear guide grooves 93, 95. Further, the first shaft rod 77 and the third shaft rod 79 are moved from the upper end portion 107 to the lower end portion 108 along the first elongate hole 151 in the state in which the first shaft rod 77 and the third shaft rod 79 are respectively fitted in the front guide grooves 92, 94. It is noted that a component pressed by the user is not limited to the upper face 74A of the bottom plate 74 and, for example, may be an upper face 85A of the projecting plate 85 (see FIG. 5A) which will be described below.

In view of the above, in the present embodiment, components used to change the posture of the tray guide 72 from the second posture to the third posture (i.e., the shaft rods 77-80, the first elongate hole 151 of the front guide grooves 92, 94, and the rear upper end portion 110 of the rear guide grooves 93, 95) function as a first posture-change portion, for example.

Where the tray guide 72 is changed from the third posture to the first posture in the following manner. When the user of the MFD 10 has took hold of a portion of the bottom plate 74 near the front end of the tray guide 72 and then pulled the bottom plate 74 frontward, the tray guide 72 is moved. Specifically, each of the second shaft rod 78 and the fourth shaft rod 80 is moved from the rear upper end portion 110 to the front lower end portion 111 in the state in which the second shaft rod 78 and the fourth shaft rod 80 are respectively fitted in the rear guide grooves 93, 95. Further, the first shaft rod 77 and the third shaft rod 79 are moved form the lower end portion 108 to the front end portion 109 along the second elongate hole 152 in the state in which the first shaft rod 77 and the third shaft rod 79 are respectively fitted in the front guide grooves 92, 94. It is noted that a component pulled by the user is not limited to the bottom plate 74 and, for example, may be the projecting plate 85 (see FIG. 5A) which will be described below.

In view of the above, in the present embodiment, components used to change the posture of the tray guide 72 from the third posture to the first posture (i.e., the shaft rods 77-80, the second elongate hole 152 of the front guide grooves 92, 94, and the rear guide grooves 93, 95) function as a second posture-change portion, for example.

It is noted that there has been explained the case where the posture of the tray guide 72 is changed from the second posture to the first posture via the third posture, but the tray guide 72 can change its posture from the first posture to the second posture via the third posture by operations of the tray guide 72 in an order reverse to the above-described order. For example, where the tray guide 72 is in the first posture, when the user of the MFD 10 has took hold of a portion of the bottom plate 74 near the front end of the tray guide 72 and then pushed the bottom plate 74 rearward, the posture of the tray guide 72 is changed from the first posture to the third posture. Then, when the user of the MFD 10 has moved the tray guide 72 upward while holding the portion of the bottom plate 74 near the front end of the tray guide 72, the tray guide 72 is pivoted about the second shaft rod 78 and the fourth shaft rod 80 as the pivot shafts to change the posture of the tray guide 72 from the third posture to the second posture.

<Coil Spring 82>

As shown in FIGS. 4A-4C, coil springs 82 are respectively mounted on the first shaft rod 77 and the third shaft rod 79. In the present embodiment, a torsion spring is used as each of the coil springs 82. Each coil spring 82 is constituted by a coil portion 83, a first arm portion 84A, and a second arm portion 84B having the same length as the first arm portion 84A.

A distal end of each first arm portion 84A is mounted on the corresponding one of the first shaft rod 77 and the third shaft rod 79 respectively extending through the guide members 90, 91. A distal end of each second arm portion 84B is mounted on a projection 96 which is provided on the corresponding one of the guide members 90, 91 so as to be located below a height level of the lower end portion 108. The distal end of each first arm portion 84A is mounted on the corresponding one of the first shaft rod 77 and the third shaft rod 79 so as to be located on a front side of the coil portion 83. Likewise, the distal end of each second arm portion 84B is mounted on the corresponding projection 96 so as to be located on a front side of the coil portion 83.

In the present embodiment, the coil spring 82 urges or biases the tray guide 72 (the bottom plate 74) toward a second-posture side in the change of the posture of the tray guide 72 between the second posture and the third posture (a function of a first force-exerting member). Further, the coil spring 82 urges the tray guide 72 toward a first-posture of side in the change of the posture of the tray guide 72 between the third posture and the first posture (a function of a second force-exerting member). Further, the coil spring 82 urges the tray guide 72 toward the second-posture side where the tray guide 72 is in the third posture (a function of a third force-exerting member). It is noted that a direction in which the coil spring 82 urges the tray guide 72 is determined by a strength of the coil spring 82, a distance between the first arm portion 84A and the second arm portion 84B, a position on which the coil portion 83 is mounted, and the like. That is, a manner in which the coil spring 82 is mounted is not limited to the above-described manner as long as the coil spring 82 urges the tray guide 72 as described above.

In view of the above, in the present embodiment, the coil spring 82 is an example of the first force-exerting member, the second force-exerting member, and the third force-exerting member. Further, the first force-exerting member, the second force-exerting member, and the third force-exerting member are constituted by a single force-exerting member (urging member), i.e., the coil spring 82. It is noted that the first force-exerting member, the second force-exerting member, and the third force-exerting member may be respectively constituted by a plurality of force-exerting members (the coil springs 82). For example, the MFD 10 may include: a first coil spring, not shown, functioning as the first force-exerting member and the second force-exerting member; and a second coil spring, not shown, functioning as the third force-exerting member.

<Projecting Plate 85>

As shown in FIGS. 4A-4C, 5A-5C and 8A-8B, the tray guide 72 includes the projecting plate 85 (as an example of a projecting portion) provided so as to project in a direction opposite to the direction in which the medium tray 71 is inserted while being on an upper front face 74E of the bottom plate 74. The projecting plate 85 is provided near a central portion (in the rightward and leftward direction 9) of the upper front face 74E of the bottom plate 74. In other words, the projecting plate 85 projects frontward from the central portion of the upper front face 74E. The projecting plate 85 is formed by a generally slim and flat plate and has the upper face 85A (as an example of a flat face) and a lower face 85B. Each of the upper face 85A and the lower face 85B of the projecting plate 85 expands along the upper face 74A and the upper front face 74E of the bottom plate 74.

Where the tray guide 72 is in the second posture, the projecting plate 85 projects frontward so as to be located on a front side of the casing 14 (i.e., the guide members 90, 91). In other words, the projecting plate 85 projects frontward from the front side (an upstream end face in the tray-enter direction) of the casing 14 on a horizontal plane. Even where the tray guide 72 is pivoted so as to take the third posture by the operation of the user, and thereby the projecting plate 85 is located on a rear side of a position of the projecting plate 85 in the second posture of the tray guide 72, the projecting plate 85 remains projecting from the casing 14 because a front face of the casing 14 inclines obliquely downward and rearward (in the tray-enter direction) as indicated by reference numeral 91A in FIG. 5A. As a result, an operability of the user is improved.

Further, as shown in FIGS. 4A-4C and 8A, the projecting plate 85 has a first recessed part 86 which is a downward recess formed in the upper face 85A so as to have a generally rectangular shape. The first recessed part 86 is formed in a generally central portion of the upper face 85A. A size of the rectangle of the first recessed part 86 is a size enough for the user to hook the first recessed part 86 with his or her finger(s).

Figure 8A:
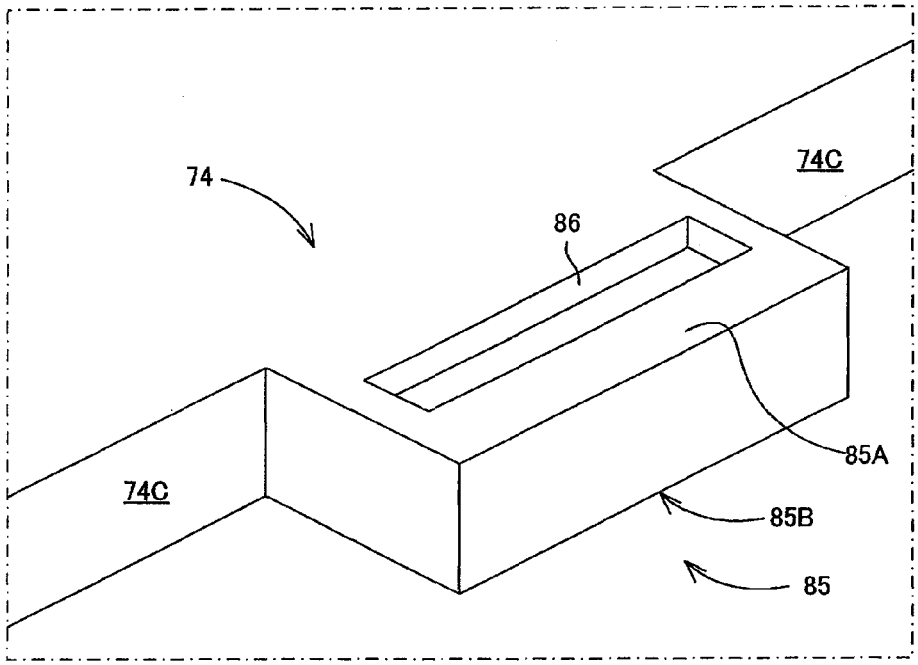
Figure 8B:
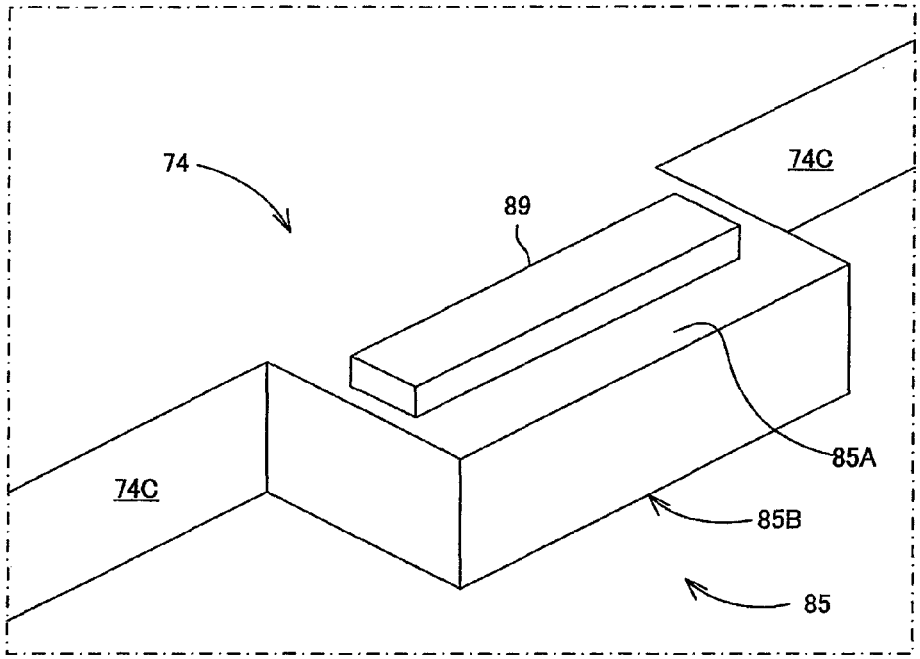

It is noted that, as shown in FIG. 8B, the projecting plate 85 may have a first projecting part 89 having a generally rectangular shape and projecting upward from the upper face 85A. A size of the rectangle of the first projecting part 89 is a size enough for the user to hook the first projecting part 89 with his or her finger(s).

Further, instead of the first recessed part 86 or the first projecting part 89, the projecting plate 85 may have (a) a second recessed part, not shown, which is an upward recess formed in the lower face 85B so as to have a generally rectangular shape or (b) a second projecting part, not shown, projecting downward from the lower face 85B so as to have a generally rectangular shape.

EFFECTS OF EMBODIMENT

In the above-described embodiment, the tray guide 72 is pivoted to change its posture from the second posture to the third posture with the rear portion of the tray guide 72 being as the pivot shaft. Then, the rear portion of the tray guide 72 is moved toward the convey path 65 or moved frontward and downward, which changes the posture of the tray guide 72 from the third posture to the first posture. That is, the posture of the tray guide 72 is changed from the second posture as a retracted posture to the first posture which is a posture for the medium tray 71 to be inserted into the MFD 10.

Further, in the above-described embodiment, a range of the pivotal movement of the tray guide 72 is determined such that the rear portion and the front portion of the tray guide 72 are located at the same height where the tray guide 72 is in the second posture. Thus, the tray guide 72 never stands upright. Accordingly, it is possible to reduce a distance of the upward movement (retraction) of the tray guide 72 upon the change of the posture thereof to the second posture. That is, in the above-described embodiment, while the tray guide 72 is changeable among the first posture, the second posture, and the third posture, it is possible to make or keep a height of the MFD 10 low or reduce the height of the MFD 10.

Further, in the above-described embodiment, where the posture of the tray guide 72 is changed from the second posture to the third posture and then to the first posture, the tray guide 72 having been in the second posture is urged by the coil spring 82 so as to be changed back to the second posture after the tray guide 72 takes the third posture and before the tray guide 72 is pivoted even a little toward the first-posture side. In contrast, where the posture of the tray guide 72 is changed from the first posture to the third posture and then to the second posture, the tray guide 72 having been in the first posture is urged by the coil spring 82 so as to be changed back to the first posture after the tray guide 72 takes the third posture and before the tray guide 72 is pivoted even a little toward the second-posture side. As a result, even where the user has changed the posture of the tray guide 72 by mistake, the tray guide 72 can be changed to the former or original posture during a period until the tray guide 72 is changed from the first posture to the third posture or a period until the tray guide 72 is changed from the second posture to the third posture.

Further, in the above-described embodiment, where the posture of the tray guide 72 has been changed from the first posture to the third posture, the posture of the tray guide 72 is changed to the second posture by the coil spring 82. That is, the change of the posture of the tray guide 72 from the first posture to the second posture is completed by a single operation (i.e., the movement of the tray guide 72 to the third posture), thereby eliminating a need for the user to perform a pivotal operation to change the posture of the tray guide 72 from the third posture to the second posture. As a result, the operability of the tray guide 72 can be improved.

Further, in the above-described embodiment, the single coil spring 82 urges the tray guide 72 toward the first-posture side and toward the second-posture side. As a result, the number of the components mounted in the MFD 10 can be reduced.

Further, in the above-described embodiment, the user can easily change the posture of the tray guide 72 by taking hold of the projecting plate 85. That is, the projecting plate 85 improves the operability of the tray guide 72.

Further, in the above-described embodiment, when changing the posture of the tray guide 72, the user can easily operate the tray guide 72 by inserting his or her finger(s) into the first recessed part 86 and/or the second recessed part. Further, when changing the posture of the tray guide 72, the user can easily operate the tray guide 72 by hooking his or her finger(s) on the first projecting part 89 and/or the second projecting part.

Further, in the above-described embodiment, the tray guide 72 includes (a) the guide member 90 having the shaft rods 77, 78 and the guide grooves 92, 93 and (b) and the guide member 91 having the shaft rods 79, 80 and the guide grooves 94, 95. Since the tray guide 72 is thus constructed, the tray guide 72 is pivotable between the second posture and the third posture and movable between the first posture and the third posture.

First Modification of Embodiment

There will be next explained a first modification of the embodiment of the present invention. In the above-described embodiment, there has been explained that the coil spring 82 urges the tray guide 72 being in the third posture toward the second-posture side but may urge the tray guide 72 being in the third posture toward the first-posture side. For example, in this first modification, the coil spring 82 is mounted on the first shaft rod 77, the third shaft rod 79, and the projection 96 such that the coil portion 83 is located on a front side of the distal ends of the respective arm portions 84A, 84B. As a result, the coil spring 82 urges the tray guide 72 being in the third posture toward the first-posture side. It is noted that, as described in the above-described embodiment, the direction in which the coil spring 82 urges the tray guide 72 is determined by the strength of the coil spring 82, the distance between the first arm portion 84A and the second arm portion 84B, the position on which the coil portion 83 is mounted, and the like. That is, the manner in which the coil spring 82 is mounted is not limited to the above-described manner as long as the coil spring 82 urges the tray guide 72 as described above. In view of the above, in this modification, the coil spring 82 functions as a fourth force-exerting member in addition to the first force-exerting member and the second force-exerting member.

In this first modification, when the tray guide 72 being in the second posture has been pivoted to take the third posture, the posture of the tray guide 72 is changed to the first posture by the coil spring 82. That is, the change of the posture of the tray guide 72 from the second posture to the first posture is completed by a single operation (i.e., the movement of the tray guide 72 to the third posture), thereby eliminating a need for the user to perform an operation to change or move the tray guide 72 from the third posture to the first posture. As a result, the operability of the tray guide 72 can be improved.

Second Modification of Embodiment

There will be next explained a second modification of the embodiment of the present invention. A shape of each of the front guide grooves 92, 94 may be different from that in the above-described embodiment. For example, each of the front guide grooves 92, 94 may have a shape explained below in order to change the posture of the tray guide 72 between the first posture and the second posture by a single action.

As shown in FIGS. 6A-6D and 7B, the MFD 10 as this second modification is configured such that each of the front guide grooves 92, 94 has, in addition to the first elongate hole 151 and the second elongate hole 152 described above, a third elongate hole 153 formed between the first elongate hole 151 and the second elongate hole 152 so as to obliquely extend with a rear portion of the hole 153 being located on an upper position, and a front portion of the hole 153 being located on a lower position lower in height than the rear portion thereof.

Specifically, the first elongate hole 151 is formed so as to extend in the direction in which the guide tray 72 pivots between the second posture and the third posture thereof. The second elongate hole 152 is formed so as to extend in the direction in which the tray guide 72 is moved between the first posture and the third posture. Further, the second elongate hole 152 is located on a lower side of the lower end portion 108 of the first elongate hole 151. Further, a rear end portion 112 of the second elongate hole 152 is located on a front side of the first elongate hole 151. That is, this second modification is different from the above-described embodiment in that the first elongate hole 151 and the second elongate hole 152 are not continuous to each other.

One of end portions of the third elongate hole 153 continues to the lower end portion 108 of the first elongate hole 151, and the other of the end portions thereof continues to the rear end portion 112 of the second elongate hole 152. That is, the third elongate hole 153 is formed by a groove between the lower end portion 108 and the rear end portion 112. In other words, the first elongate hole 151 and the second elongate hole 152 are formed so as to be continuous to each other via the third elongate hole 153.

Figure 6A:
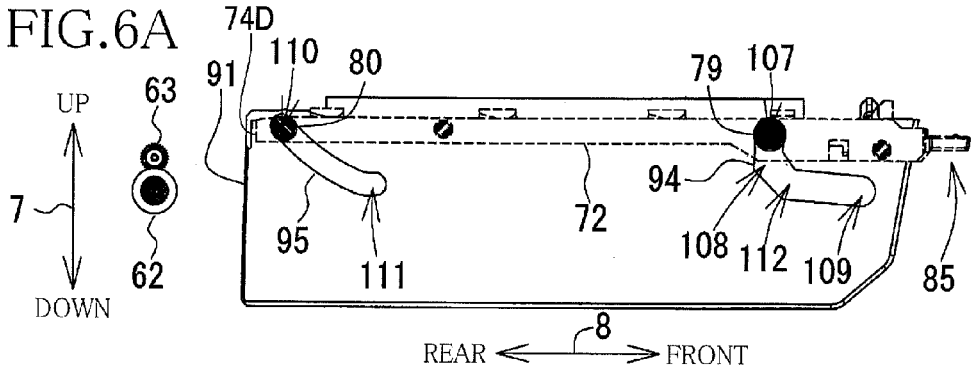
Figure 6B:
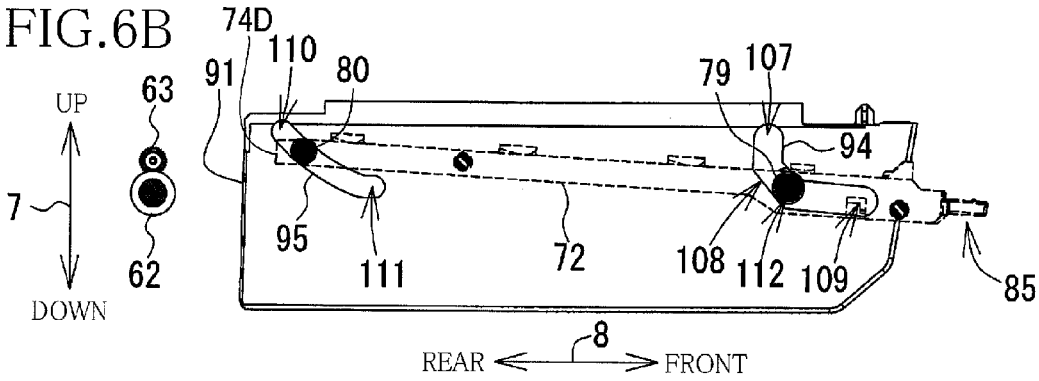
Figure 6C:
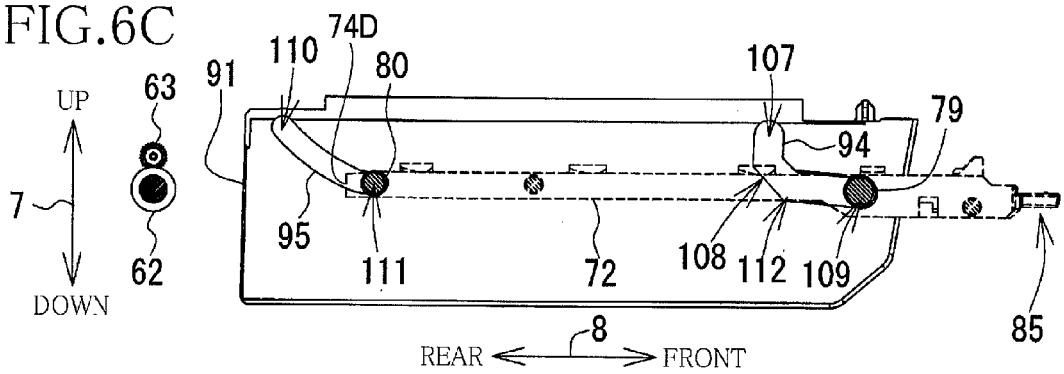

When the tray guide 72 takes the third posture, it is possible for the first shaft rod 77 and the third shaft rod 79 to be located at two positions. That is, as shown in FIG. 6B, where the posture of the tray guide 72 is changed from the second posture to the third posture, the tray guide 72 takes the third posture by the movement of the first shaft rod 77 and the third shaft rod 79 to the rear end portion 112. In this case, a force of each coil spring 82 to urge and move the corresponding one of the first shaft rod 77 and the third shaft rod 79 from the rear end portion 112 to the front end portion 109 is greater than a force of each coil spring 82 to urge and move the corresponding one of the first shaft rod 77 and the third shaft rod 79 from the rear end portion 112 to the lower end portion 108. Thus, where the posture of the tray guide 72 is changed to the third posture, the posture is automatically changed to the first posture.

Figure 6D:
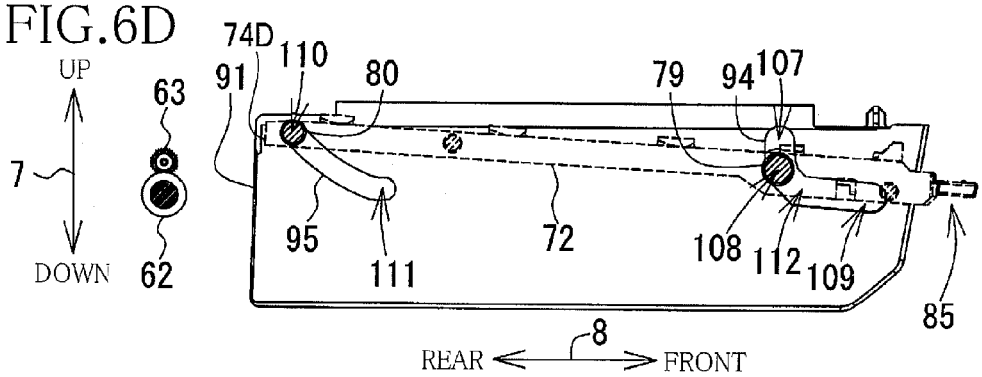
Figure 7A:
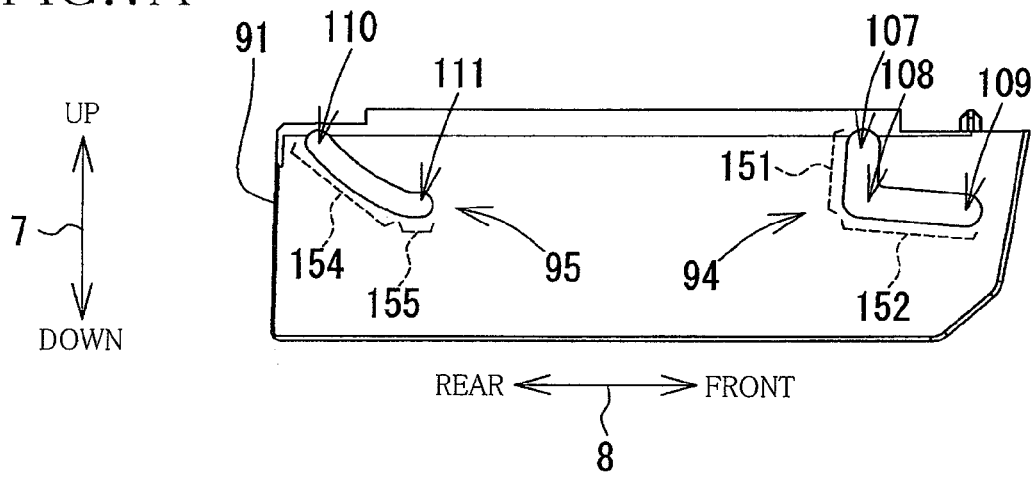
FIGS. 7A and 7B are elevational views in vertical cross section schematically showing guide grooves 92, 93, wherein FIG. 7A corresponds to FIGS. 5A through 5C, and FIG. 7B corresponds to FIGS. 6A through 6D.
Figure 7B:
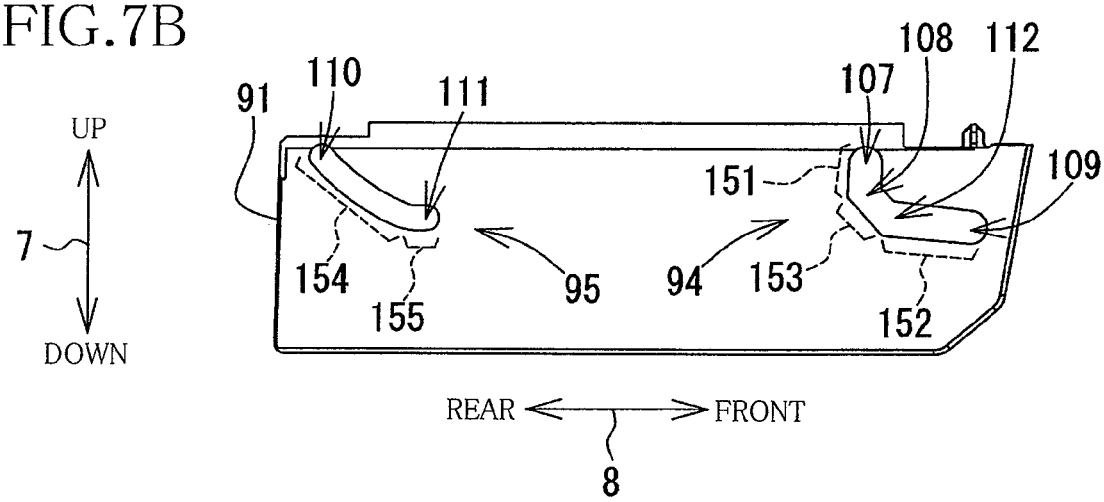

On the other hand, as shown in FIG. 6D, where the posture of the tray guide 72 is changed from the first posture to the third posture, the first shaft rod 77 and the third shaft rod 79 are moved to the lower end portion 108 to change the tray guide 72 to the third posture. In this case, a force of each coil spring 82 to urge and move the corresponding one of the first shaft rod 77 and the third shaft rod 79 from the lower end portion 108 to the upper end portion 107 is greater than a force of each coil spring 82 to urge and move the corresponding one of the first shaft rod 77 and the third shaft rod 79 from the lower end portion 108 to the rear end portion 112. Thus, where the posture of the tray guide 72 is changed to the third posture, the posture is automatically changed to the second posture.

In view of the above, in the second modification, the change of the posture of the tray guide 72 from the first posture to the second posture is completed by a single operation (i.e., the movement of the tray guide 72 to the third posture), and the change of the posture of the tray guide 72 from the second posture to the first posture is also completed by a single operation (i.e., the pivotal movement of the tray guide 72 to the third posture). As a result, the operability of the tray guide 72 can be improved.

Third Modification of Embodiment

There will be next explained a third modification of the embodiment of the present invention. The projecting plate 85 may be pivotable with respect to the tray guide 72 being in the second posture with the rightward and leftward direction 9 being as its axis direction, between (a) a fourth posture indicated by a solid line in FIG. 9A in which the upper face 85A and the lower face 85B are horizontal and (b) a fifth posture lower in height than the fourth posture and indicated by a broken line in FIG. 9A and a solid line in FIG. 9B, for example.

Figure 9A:
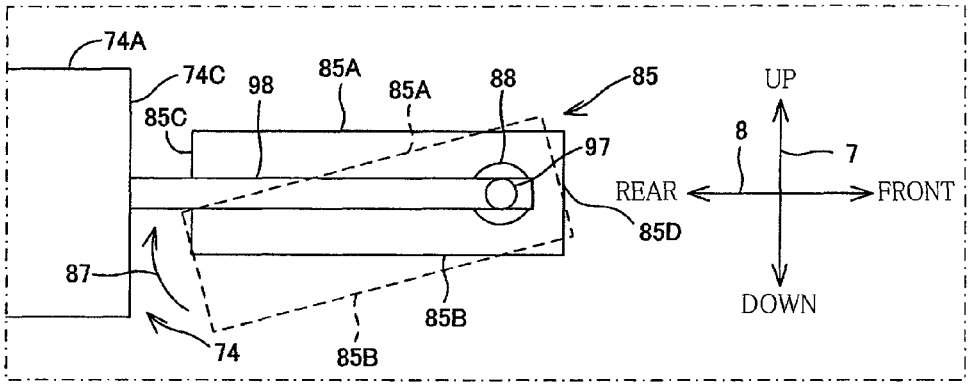
Figure 9B:
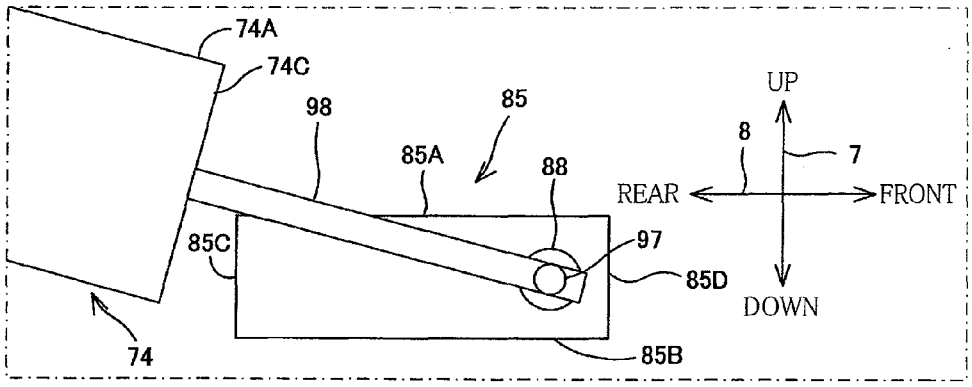

As indicated by the solid line in FIG. 9A, the upper face 85A and the lower face 85B of the projecting plate 85 are parallel to the upper face 74A of the bottom plate 74 of the tray guide 72 in the fourth posture. As shown in FIG. 9B, the upper face 85A and the lower face 85B of the projecting plate 85 expand in the frontward and rearward direction 8 or are horizontal where the tray guide 72 is in the third posture.

Figure 9C:
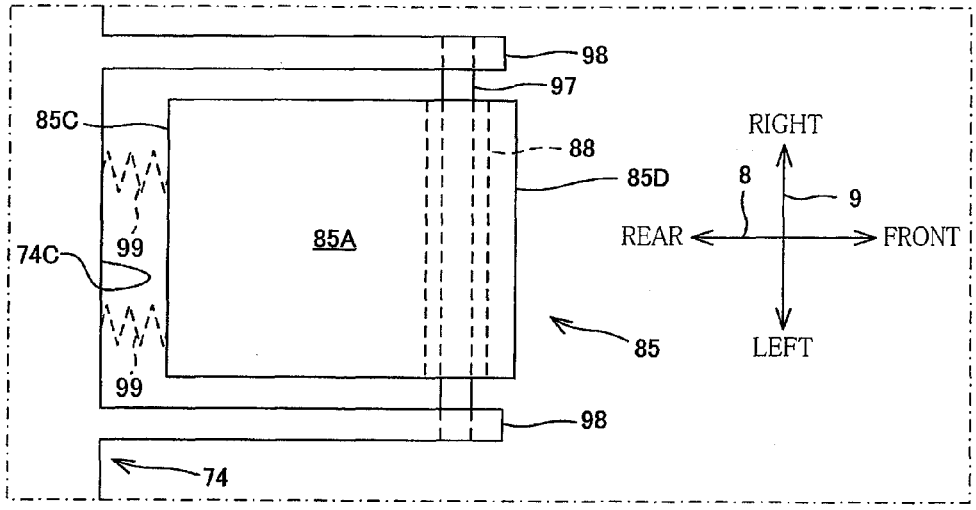

As shown in FIGS. 9A-9C, the projecting plate 85 has a shaft hole 88 extending in the rightward and leftward direction 9 in order to change the posture of the projecting plate 85 between the fourth posture and the fifth posture. The projecting plate 85 has a rear end portion 85C and a front end portion 85D opposite to each other, the rear end portion 85C facing the front end 74C of the bottom plate 74. The shaft hole 88 is located near the front end portion 85D of the projecting plate 85. A pivot shaft 97 is fitted in the shaft hole 88 so as to extend through the shaft hole 88. As shown in FIG. 9C, the pivot shaft 97 is rotatably supported at its opposite end portions by respective projections 98 projecting from the front end 74C of the bottom plate 74. That is, the shaft hole 88 and the pivot shaft 97 function as a pivoting portion.

Further, the projecting plate 85 may be urged or biased in a direction indicated by an arrow 87 in FIG. 9A, that is, in a direction from the fifth posture toward the fourth posture. For example, as indicated by broken lines in FIG. 9C, the front end 74C of the bottom plate 74 and the rear end portion 85C of the projecting plate 85 are connected to each other by an urging member 99 as an example of a fifth force-exerting member. The urging member 99 is formed by a coil spring, for example. Where the projecting plate 85 is in the fourth posture, a length of the coil spring 99 is its original length. When the posture of the projecting plate 85 is changed from the fourth posture to the fifth posture, the coil spring 99 is extended. At this time, the coil spring 99 generates an elastic force in a direction in which the coil spring 99 is contracted, to urge the projecting plate 85 toward a fourth-posture side.

In this third modification, in a case where the posture of the tray guide 72 is changed from the second posture to the third posture by the user pressing the projecting plate 85 of the tray guide 72 being in the second posture from an upper side thereof, even where the tray guide 72 has been inclined, the upper face 85A and the lower face 85B of the projecting plate 85 are kept horizontal. As a result, the user can easily operate the tray guide 72.

Fourth Modification of Embodiment

There will be next explained a fourth modification of the embodiment of the present invention. In the above-described embodiment, the second posture is located on an upper side of the first posture but may be located on a lower side of the first posture. That is, the tray guide 72 may be retracted from the convey path 65 at a position lower in height than the first posture. In this case, the third posture is a posture in which the tray guide 72 has been pivoted such that the front portion thereof has been moved upward with respect to the second posture, with the second shaft rod 78 and the fourth shaft rod 80 being as the pivotal shafts.

Fifth Modification of Embodiment

Figure 10:
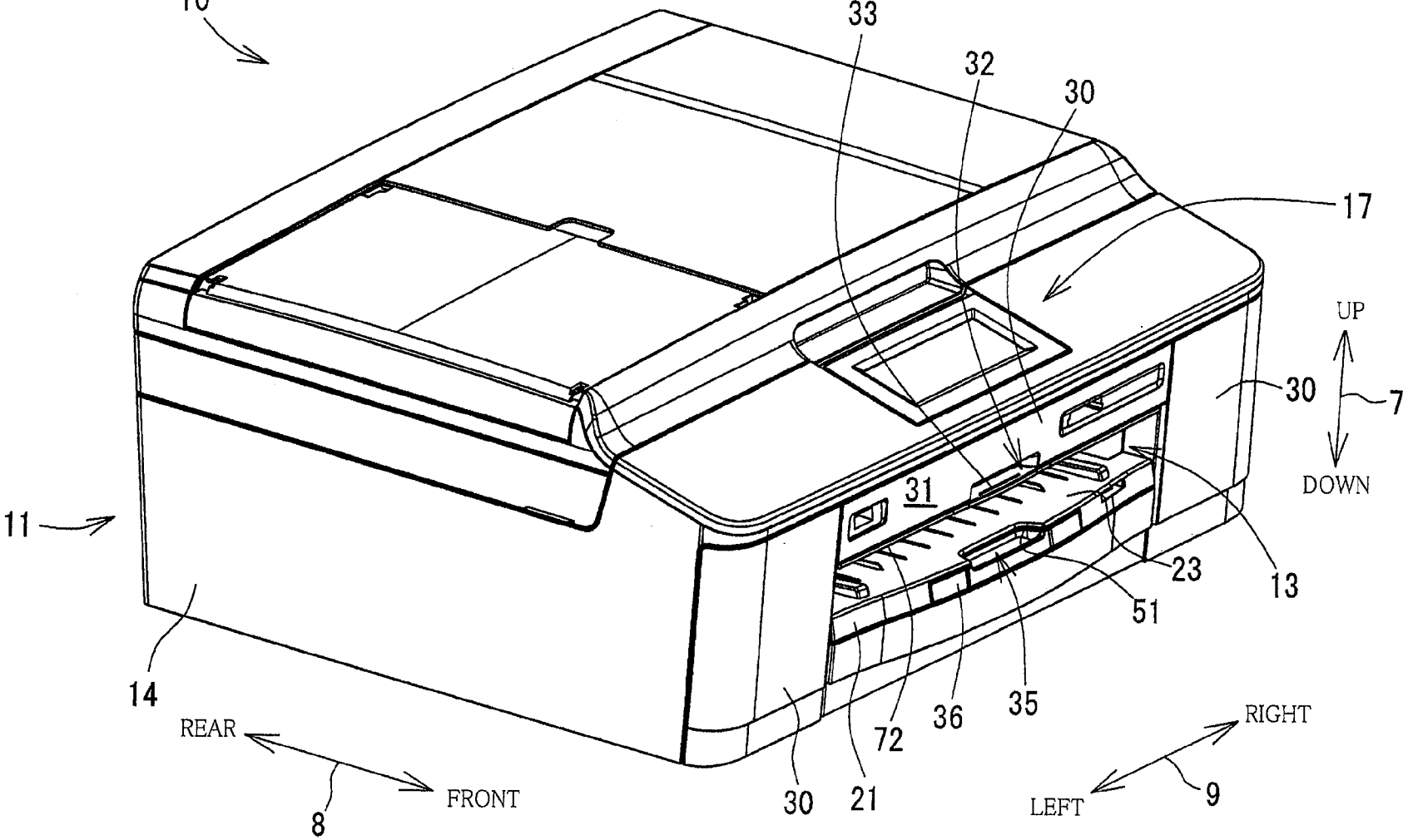
FIG. 10 is an external perspective view showing an MFD 10 as a fifth modification with the tray guide 72 being in the second posture.

There will be next explained a fifth modification of the embodiment of the present invention. As shown in FIG. 10, in the second posture, the tray guide 72 is located near an upper end of the opening 13. The opening 13 is formed in a front wall 30 of the casing 14 of the MFD 10. The front wall 30 has an upper wall 31 (as one example of a casing front wall) as an upper portion thereof located on an upper side of the opening 13. The upper wall 31 is formed on an upper side of the front end of the tray guide 72 being in the second posture.

The sheet-discharge tray 21 is mounted on and removed from the MFD 10 through the opening 13. The sheet-discharge tray 21 is disposed under the tray guide 72 in a state in which the sheet-discharge tray 21 is mounted on the MFD 10. The recording sheet on which the image has been recorded by the recording portion 24 is discharged onto an upper face 23 of the sheet-discharge tray 21 (as one example of a medium-placed face).

An upward recess is formed in a part of an lower end of a front face of the upper wall 31. That is, a third recessed part 32 recessed upward from the lower end is formed in the upper wall 31. Further, the third recessed part 32 is recessed rearward from the front face of the upper wall 31. The third recessed part 32 is formed at a central portion of the upper wall 31 in the rightward and leftward direction 9. In view of the above, the upper wall 31 has a space defined by the third recessed part 32 and formed at the central portion (in the rightward and leftward direction 9) of the front lower portion of the upper wall 31. It is noted that a position of the third recessed part 32 in the rightward and leftward direction 9 is not limited to the central portion of the upper wall 31. For example, the third recessed part 32 may be formed in a left or a right end portion of the upper wall 31.

Since the third recessed part 32 is formed, a portion of the upper face of the tray guide 72 is exposed to the outside of the MFD 10 through the third recessed part 32. A recess 33 having a generally rectangular shape and recessed downward is formed at the portion of the upper face of the tray guide 72, which portion is exposed to the outside of the MFD 10. It is noted that the recess 33 may be omitted. Further, a projection may be formed instead of the recess 33. Further, the recess 33 or the projection may be formed at a portion of the lower face of the tray guide 72, which portion is exposed to the outside of the MFD 10.

A fourth recessed part 35 recessed downward is formed in the upper face 23 of the sheet-discharge tray 21. Further, the fourth recessed part 35 is recessed rearward from a front end of the sheet-discharge tray 21. The fourth recessed part 35 is formed just under the third recessed part 32. That is, the fourth recessed part 35 is formed at a position corresponding to the position of the third recessed part 32 in the rightward and leftward direction 9. In this modification, the fourth recessed part 35 is formed in a central portion of the upper face 23 of the sheet-discharge tray 21 in the rightward and leftward direction 9 (as one example of a widthwise direction of the sheet-discharge tray 21). In view of the above, the sheet-discharge tray 21 has a space defined by the fourth recessed part 35 and formed at the central portion (in the rightward and leftward direction 9) of the front upper portion of the sheet-discharge tray 21.

In a state shown in FIG. 10, the user of the MFD 10 can press down the upper face of the tray guide 72 being in the second posture through the space formed in the upper wall 31. Alternatively, while grasping the tray guide 72 being in the second posture, the user of the MFD 10 can pivot the tray guide 72 downward through the space formed in the upper wall 31 and the space formed in the sheet-discharge tray 21. As a result, as shown in FIG. 11, the posture of the tray guide 72 is changed from the second posture to the third posture.

Figure 11:
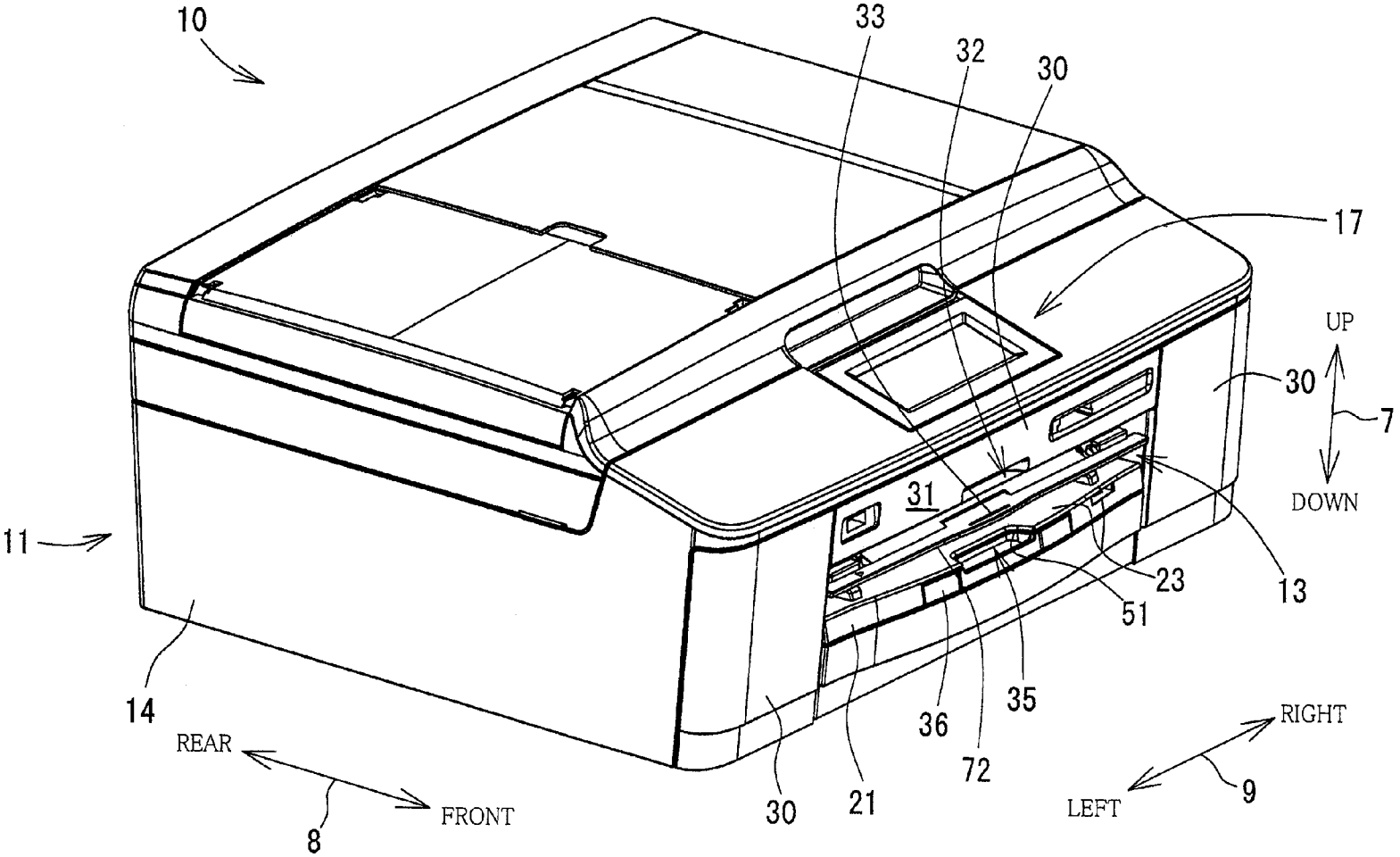
FIG. 11 is an external perspective view showing the MFD 10 as the fifth modification with the tray guide 72 being in the third posture.
Figure 12:
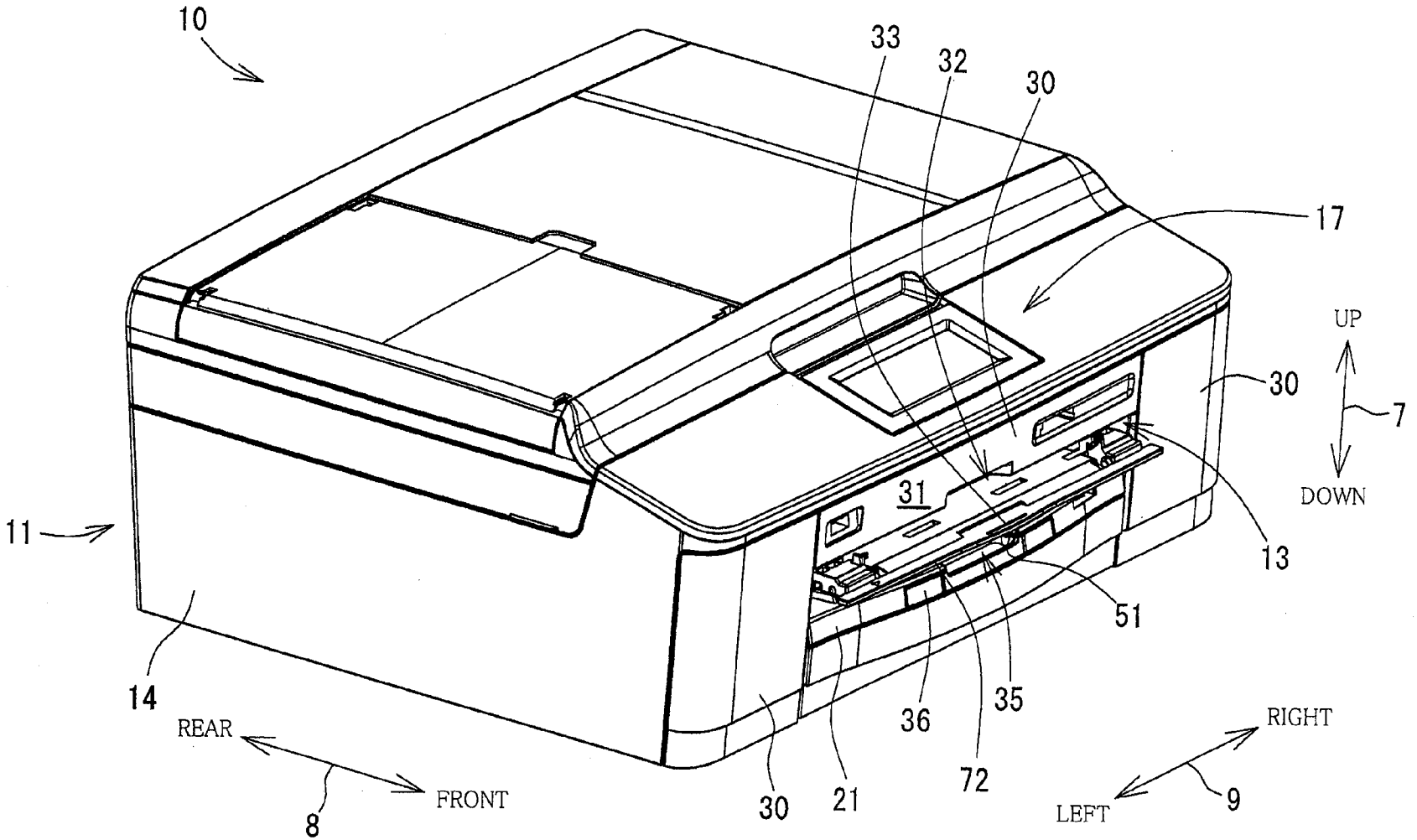
FIG. 12 is an external perspective view showing the MFD 10 as the fifth modification with the tray guide 72 being in the first posture.

In a state shown in FIG. 11, while grasping the tray guide 72 being in the second posture, the user of the MFD 10 can pull the tray guide 72 frontward through the space formed in the upper wall 31 and the space formed in the sheet-discharge tray 21. As a result, as shown in FIG. 12, the tray guide 72 is urged by the coil spring 82 to be changed from the third posture to the first posture. It is noted that, in the case of the first modification, when having been changed to the third posture, the tray guide 72 is urged by the coil spring 82 to be automatically changed to the first posture.

In a state shown in FIG. 12, while grasping the tray guide 72 being in the first posture, the user of the MFD 10 can press the tray guide 72 rearward. As a result, as shown in FIG. 11, the posture of the tray guide 72 is changed from the first posture to the third posture. As shown in FIG. 10, the tray guide 72 having been changed to the third posture is urged by the coil spring 82 to be automatically changed to the second posture. It is noted that, in the case of the first modification, the user of the MFD 10 can press up the lower face of the tray guide 72 being in the third posture through the space formed in the sheet-discharge tray 21. Alternatively, while grasping the tray guide 72 being in the third posture, the user of the MFD 10 can pivot the tray guide 72 upward through the space formed in the upper wall 31 and the space formed in the sheet-discharge tray 21. As a result, as shown in FIG. 10, the tray guide 72 is urged by the coil spring 82 to be changed from the third posture to the second posture.

According to this fifth modification, since the third recessed part 32 and the fourth recessed part 35 are formed, the spaces are formed respectively on upper and lower sides of the tray guide 72. As a result, when the posture of the tray guide 72 is changed, a space for an operation of the user is increased. That is, the third recessed part 32 and the fourth recessed part 35 improve the operability of the tray guide 72.

Sixth Modification of Embodiment

There will be next explained a sixth modification of the embodiment of the present invention. As shown in FIG. 10, an expanded tray 36 (as one example of a sub-discharge tray) is accommodated in an accommodating space formed in a back side of the upper face 23 of the sheet-discharge tray 21.

As shown in FIGS. 10-13, the expanded tray 36 is configured to be projected from or retracted into the sheet-discharge tray 21 through an opening formed in a front face of the sheet-discharge tray 21. Specifically, the expanded tray 36 is movable between (a) a first position (shown in FIGS. 10-12) at which the expanded tray 36 is completely accommodated in the accommodating space of the sheet-discharge tray 21 and (b) a second position (shown in FIG. 13) at which the expanded tray 36 is projected from the accommodating space of the sheet-discharge tray 21 such that an exposed area of the upper face 37 of the expanded tray 36 is maximized.

Figure 13:
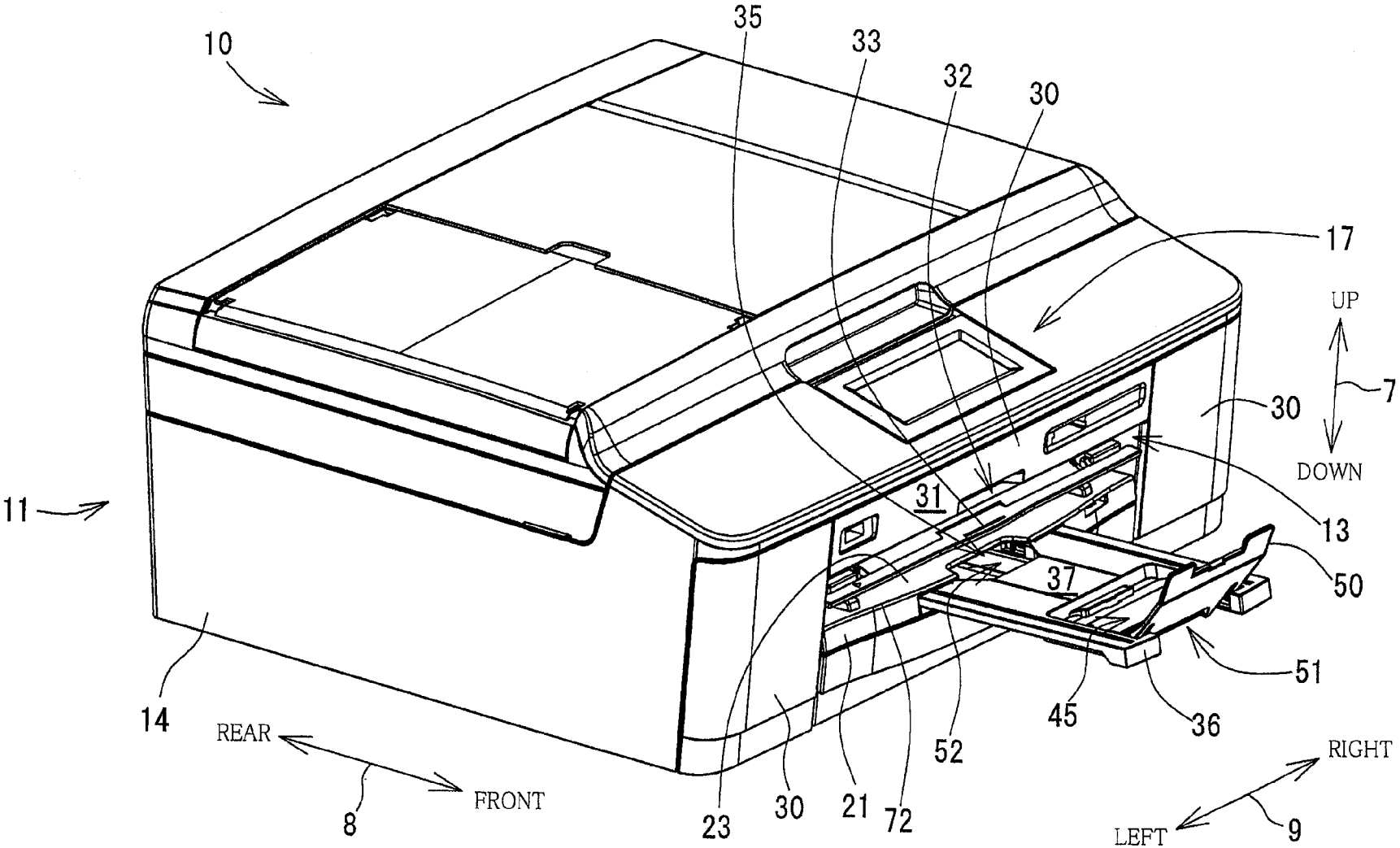
FIG. 13 is an external perspective view showing an MFD 10 as a sixth modification.

As shown in FIG. 13, a stopper 50 is mounted on the expanded tray 36. The stopper 50 is for stopping or preventing the recording sheet having been discharged onto the expanded tray 36 from hanging over or falling from a front end of the expanded tray 36.

The stopper 50 is accommodatable in a recessed part 45 formed in the upper face 37 of the expanded tray 36. A shaft hole, not shown, is formed in a front end portion of an inner side face of the recessed part 45. An axial direction of the shaft hole coincides with the rightward and leftward direction 9. The stopper 50 includes a pivot shaft, not shown, which projects outwardly from opposite side portions of the stopper 50 in the rightward and leftward direction 9. This pivot shaft is inserted into the shaft hole formed in the recessed part 45 and supported by the shaft hole. As a result, the stopper 50 is supported by a front end portion of the expanded tray 36 so as to be pivotable about the pivot shaft.

The stopper 50 is pivotable between (a) a lying posture (as one example of a sixth posture) in which the stopper 50 lies down or is flat on the upper face 37 and accommodated in the recessed part 45 and (b) an inclined posture shown in FIG. 13 (as one example of a seventh posture) in which the stopper 50 is inclined at a predetermined angle with respect to the upper face 37. The posture of the stopper 50 is changed to the lying posture where the stopper is not used, and is changed to the inclined posture where the stopper is used. The posture of the stopper 50 is changed where the expanded tray 36 is in the second position. On the other hand, where the expanded tray 36 is located at the first position, the posture of the stopper 50 is not changed because the expanded tray 36 is accommodated in the sheet-discharge tray 21.

A cutout 51 is formed in a pivotal basal end portion of the stopper 50, i.e., a front end portion of the stopper 50. Specifically, the cutout 51 is formed so as to extend rearwardly in the frontward and rearward direction 8 from the front end portion of the upper face of the stopper 50 being in the lying posture. The cutout 51 is located at a position corresponding in the rightward and leftward direction 9 to a position at which the fourth recessed part 35 is formed, that is, the cutout 51 is located just under the fourth recessed part 35 where the expanded tray 36 is located at the first position. As a result, as shown in FIG. 10, the cutout 51 partly constitutes the fourth recessed part 35 in the state in which the expanded tray 36 is located at the first position.

According to this sixth modification, the user can move the expanded tray 36 by holding, with his or her hand, the portion of the expanded tray 36 in which the cutout 51 is formed. That is, the cutout 51 improves an operability of the expanded tray 36. Further, according to the sixth modification, the cutout 51 is formed at the position corresponding in the rightward and leftward direction 9 to the position at which the fourth recessed part 35 is formed. Accordingly, a space for the operation of the user is also formed by the cutout 51 in addition to the space formed by the fourth recessed part 35. That is, the space for the operation of the user is increased. As a result, it is possible to improve the operability of the tray guide 72.

Seventh Modification of Embodiment

There will be next explained a seventh modification of the embodiment of the present invention. As shown in FIG. 13, in the sixth modification, a fifth recessed part 52 recessed downward may be formed in the upper face 37 of the expanded tray 36. The fifth recessed part 52 is formed near a rear end of the upper face 37 of the expanded tray 36. As described above, the movement of the expanded tray 36 to the second position maximizes the exposed area of the upper face 37 of the expanded tray 36. As a result, as shown in FIG. 13, the fifth recessed part 52 is just under the fourth recessed part 35. That is, in the state in which the expanded tray 36 is located at the second position, the fifth recessed part 52 is located at the position corresponding to the position at which the fourth recessed part 35 is formed. As a result, the space for the operation of the user is increased. Accordingly, it is possible to improve the operability of the tray guide 72.

What is claimed is:

1. An image recording apparatus comprising:

a recording portion configured to record an image on one of a first recording medium and a second recording medium;

a tray on which the first recording medium is placed;

a convey path configured to selectively convey one of the second recording medium and the tray on which the first recording medium is placed;

a tray guide configured to change among (a) a first posture in which the tray guide supports the tray such that the tray is enabled to enter into the convey path for recording the image on the first recording medium by the recording portion, (b) a second posture in which the tray guide is located at a position different from a position of the tray guide in the first posture in a direction intersecting the convey path, and the tray guide is located on a downstream side of the position of the tray guide in the first posture in a tray-enter direction in which the tray enters into the convey path, and (c) a third posture in which an upstream portion of the tray guide in the tray-enter direction is nearer to the convey path than the upstream portion of the tray guide in the second posture, the third posture being a posture of the tray guide in which the upstream portion of the tray guide is nearer to the convey path than a downstream portion of the tray guide in the tray-enter direction such that the tray guide inclines obliquely with respect to the convey path;

a first posture-change portion configured to change the posture of the tray guide from the second posture to the third posture by pivoting the tray guide in the second posture about the downstream portion of the tray guide in the tray-enter direction such that the upstream portion of the tray guide is moved toward the convey path; and a second posture-change portion configured to change the posture of the tray guide from the third posture to the first posture by moving the downstream portion of the tray guide in the third posture toward the convey path and by moving the tray guide to an upstream side thereof in the tray-enter direction, wherein the convey path is configured to discharge the second recording medium after the recording portion records the image thereon to an outside of the image recording apparatus when the tray guide is disposed in the second posture.

2. The image recording apparatus according to claim 1, further comprising an inner guide member configured to define a lower side of the convey path in an upward and downward direction so as to function as a lower guide face of the convey path, wherein an upper face of the tray guide in the first posture is located at the same height as an upper face of the inner guide member in the upward and downward direction.

3. The image recording apparatus according to claim 2, wherein the tray guide is disposed at an upstream side of the inner guide member in the tray-enter direction.

4. The image recording apparatus according to claim 1, further comprising:

a first force-exerting member configured to exert a force on the tray guide so as for the tray guide to take the second posture in the posture change of the tray guide between the second posture and the third posture; and a second force-exerting member configured to exert a force on the tray guide so as for the tray guide to take the first posture in the posture change of the tray guide between the third posture and the first posture.

5. The image recording apparatus according to claim 4, further comprising a third force-exerting member configured to exert a force on the tray guide in the third posture so as for the tray guide to take the second posture.

6. The image recording apparatus according to claim 4, further comprising a fourth force-exerting member configured to exert a force on the tray guide in the third posture so as for the tray guide to take the first posture.

7. The image recording apparatus according to claim 4, wherein the first force-exerting member and the second force-exerting member are constituted by one member.

8. The image recording apparatus according to claim 1, wherein the tray guide includes a projecting portion projecting, in a direction opposite to the tray-enter direction, from an upstream end of the tray guide in the tray-enter direction.

9. The image recording apparatus according to claim 8, wherein the projecting portion has an upper face expanding in the tray-enter direction, the upper face having a first recessed part formed therein so as to be recessed downward.

10. The image recording apparatus according to claim 8, wherein the projecting portion has an upper face expanding in the tray-enter direction, the upper face having a first projecting part formed thereon so as to project upward.

11. The image recording apparatus according to claim 8, wherein the projecting portion has a lower face expanding in the tray-enter direction, the lower face having a second recessed part formed therein so as to be recessed upward.

12. The image recording apparatus according to claim 8, wherein the projecting portion has a lower face expanding in the tray-enter direction, the lower face having a second projecting part formed thereon so as to project downward.

13. The image recording apparatus according to claim 8, further comprising a support member configured to support the tray guide such that the posture of the tray guide is changeable, wherein, where the tray guide is in the second posture, the projecting portion is configured to project, in the direction opposite to the tray-enter direction on a horizontal plane, from an upstream end face of the support member in the tray-enter direction, and wherein, where the tray guide is in the third posture, the upstream end face of the support member is inclined with respect to an upward and downward direction such that the projecting portion projects from the upstream end face of the support member in the direction opposite to the tray-enter direction on the horizontal plane.

14. The image recording apparatus according to claim 1, further comprising:

a first shaft portion configured to project from opposite ends of the tray guide in a widthwise direction thereof which is perpendicular to the tray-enter direction;

a second shaft portion provided on a downstream side of the first shaft portion in the tray-enter direction and configured to project from the opposite ends of the tray guide in the widthwise direction thereof;

a first guide member provided at a position opposed to the first shaft portion, the first guide member having a first guide groove formed therein in which the first shaft portion is capable of being fitted; and a second guide member provided at a position opposed to the second shaft portion, the second guide member having a second guide groove formed therein in which the second shaft portion is capable of being fitted, wherein the first guide groove is formed so as to extend in a pivotal direction of the pivotal movement of the tray guide and in a moving direction of the movement of the tray guide, wherein the first shaft portion is guided in the pivotal direction in the posture change of the tray guide between the second posture and the third posture, and the first shaft portion is guided in the moving direction in the posture change of the tray guide between the first posture and the third posture, wherein the second guide groove is formed so as to extend obliquely in a downward direction and in a direction opposite to the tray-enter direction, and wherein the tray guide is pivoted about the second shaft portion in the posture change of the tray guide between the second posture and the third posture, and the second shaft portion is guided in a direction in which the second guide groove extends in the posture change of the tray guide between the first posture and the third posture.

15. The image recording apparatus according to claim 14, wherein the first guide groove comprises:

a first elongate hole formed so as to extend in the pivotal direction;

a second elongate hole formed so as to extend in the moving direction, the second elongate hole being located nearer to the convey path than one end of the first elongate hole and on an upstream side of the first elongate hole in the tray-enter direction; and a third elongate hole having two end portions, one of which is connected to the first elongate hole, and the other of which is connected to a downstream end portion of the second elongate hole in the tray-enter direction, the third elongate hole extending in a direction in which second guide groove extends.

16. The image recording apparatus according to claim 1, further comprising:

a casing front wall formed on an upper side of an upstream end portion of the tray guide being in the second posture; and a discharge tray which is provided on a lower side of the tray guide and on which the second recording medium discharged from the convey path to the outside of the image recording apparatus is placeable, wherein the casing front wall has a third recessed part formed therein and recessed upward from a lower end of the casing front wall, and wherein the discharge tray has a fourth recessed part formed therein and recessed downward at a position on an upstream end portion of a medium-placed face of the discharge tray on which the second recording medium is placeable, the position corresponding, in a widthwise direction of the discharge tray, to a position at which the third recessed part is formed, the widthwise direction being perpendicular to the tray-enter direction and along the medium-placed face.

17. The image recording apparatus according to claim 1, wherein the tray guide inclines downward from the downstream portion in the tray-enter direction to the upstream portion in the third posture.

18. An image recording apparatus comprising:

a recording portion configured to record an image on one of a first recording medium and a second recording medium;

a tray on which the first recording medium is placed;

a convey path configured to selectively convey one of the second recording medium and the tray on which the first recording medium is placed;

a tray guide configured to change among (a) a first posture in which the tray guide supports the tray such that the tray is enabled to enter into the convey path for recording the image on the first recording medium by the recording portion, (b) a second posture in which the tray guide is located at a position different from a position of the tray guide in the first posture in a direction intersecting the convey path, and the tray guide is located on a downstream side of the position of the tray guide in the first posture in a tray-enter direction in which the tray enters into the convey path, and (c) a third posture in which an upstream portion of the tray guide in the tray-enter direction is nearer to the convey path than the upstream portion of the tray guide in the second posture;

a first posture-change portion configured to change the posture of the tray guide from the second posture to the third posture by pivoting the tray guide in the second posture about a downstream portion of the tray guide in the tray-enter direction such that the upstream portion of the tray guide is moved toward the convey path; and a second posture-change portion configured to change the posture of the tray guide from the third posture to the first posture by moving the downstream portion of the tray guide in the third posture toward the convey path and by moving the tray guide to an upstream side thereof in the tray-enter direction, wherein the convey path is configured to discharge the second recording medium after the recording portion records the image thereon to an outside of the image recording apparatus when the tray guide is disposed in the second posture, wherein the projecting portion has a flat face expanding in the tray-enter direction, and the tray guide has a support face for supporting the tray, wherein a posture of the projecting portion is changeable between (a) a fourth posture in which the flat face of the projecting portion is parallel to the support face of the tray guide and (b) a fifth posture in which the tray guide is inclined with respect to the support face such that the flat face is horizontal when the tray guide is in the third posture, and wherein the image recording apparatus further comprises:

a pivoting portion configured to pivot the projecting portion between the fourth posture and the fifth posture about a direction along the support face and perpendicular to the tray-enter direction; and a fifth force-exerting member configured to exert a force on the projecting portion so as for the projecting portion to take the fourth posture.

19. An image recording apparatus comprising:

a recording portion configured to record an image on one of a first recording medium and a second recording medium;

a tray on which the first recording medium is placed;

a convey path configured to selectively convey one of the second recording medium and the tray on which the first recording medium is placed;

a tray guide configured to change among (a) a first posture in which the tray guide supports the tray such that the tray is enabled to enter into the convey path for recording the image on the first recording medium by the recording portion, (b) a second posture in which the tray guide is located at a position different from a position of the tray guide in the first posture in a direction intersecting the convey path, and the tray guide is located on a downstream side of the position of the tray guide in the first posture in a tray-enter direction in which the tray enters into the convey path, and (c) a third posture in which an upstream portion of the tray guide in the tray-enter direction is nearer to the convey path than the upstream portion of the tray guide in the second posture;

a first posture-change portion configured to change the posture of the tray guide from the second posture to the third posture by pivoting the tray guide in the second posture about a downstream portion of the tray guide in the tray-enter direction such that the upstream portion of the tray guide is moved toward the convey path; and a second posture-change portion configured to change the posture of the tray guide from the third posture to the first posture by moving the downstream portion of the tray guide in the third posture toward the convey path and by moving the tray guide to an upstream side thereof in the tray-enter direction, a casing front wall formed on an upper side of an upstream end portion of the tray guide being in the second posture; and a discharge tray which is provided on a lower side of the tray guide and on which the second recording medium discharged from the convey path to an outside of the image recording apparatus is placeable when the tray guide is disposed in the second posture, wherein the casing front wall has a third recessed part formed therein and recessed upward from a lower end of the casing front wall, and wherein the discharge tray has a fourth recessed part formed therein and recessed downward at a position on an upstream end portion of a medium-placed face of the discharge tray on which the second recording medium is placeable, the position corresponding, in a widthwise direction of the discharge tray, to a position at which the third recessed part is formed, the widthwise direction being perpendicular to the tray-enter direction and along the medium-placed face, wherein the image recording apparatus, further comprises:

a sub-discharge tray movable between (a) a first position at which the sub-discharge tray is accommodated in the discharge tray and (b) a second position at which the sub-discharge tray projects from the upstream end portion of the discharge tray in a direction opposite to the tray-enter direction; and a stopper mounted on the sub-discharge tray so as to be pivotable relative to the sub-discharge tray about a shaft provided on an upstream end portion of the sub-discharge tray and extending in the widthwise direction, wherein the stopper is pivotable between (a) a sixth posture in which the stopper lies down relative to an upper face of the sub-discharge tray and (b) a seventh posture in which the stopper is inclined with respect to the upper face of the sub-discharge tray, and wherein an upstream end portion of an upper face of the stopper being in the sixth posture has a cutout formed therein at a position corresponding, in the widthwise direction, to the position at which the fourth recessed part is formed.

20. The image recording apparatus according to claim 19, wherein the sub-discharge tray has a fifth recessed part formed in the upper face of the sub-discharge tray and recessed downward at a position corresponding to a position at which the fourth recessed part is located where the sub-discharge tray is located at the second position.

* * * * *